US010005286B2

(12) United States Patent
Oya et al.

(10) Patent No.: US 10,005,286 B2
(45) Date of Patent: Jun. 26, 2018

(54) LIQUID SUPPLY UNIT

(71) Applicant: SEIKO EPSON CORPORATION, Tokyo (JP)

(72) Inventors: Shun Oya, Kiso-machi (JP); Taku Ishizawa, Matsumoto (JP); Atsushi Kobayashi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days. days.

(21) Appl. No.: 15/360,990

(22) Filed: Nov. 23, 2016

(65) Prior Publication Data

US 2017/0151793 A1 Jun. 1, 2017

(30) Foreign Application Priority Data

Nov. 27, 2015 (JP) ..... 2015-231549

(51) Int. Cl.
*B41J 2/175* (2006.01)

(52) U.S. Cl.
CPC ..... *B41J 2/17553* (2013.01); *B41J 2/175* (2013.01); *B41J 2/1752* (2013.01); *B41J 2/17523* (2013.01); *B41J 2/17526* (2013.01)

(58) Field of Classification Search
CPC ..... B41J 2/17526; B41J 2/1753
See application file for complete search history.

(56) References Cited

U.S. PATENT DOCUMENTS 5,956,057 A * 9/1999 Childers ..... B41J 2/17509 347/19
6,286,932 B1 9/2001 Hirano
2002/0118262 A1* 8/2002 Seino ..... B41J 2/17523 347/86

(Continued)

FOREIGN PATENT DOCUMENTS

CN 103522762 A 1/2014
EP 2 857 206 A1 4/2015

(Continued)

OTHER PUBLICATIONS

Extended European Search Report dated May 2, 2017 in related European Appl. No. 16200674.6 (13 pgs.).

*Primary Examiner* — Shelby Fidler
(74) *Attorney, Agent, or Firm* — Foley & Lardner LLP

(57) ABSTRACT

A liquid supply unit is provided with a liquid supply part, an outer peripheral wall, contact portions and a positioning portion. When a plane including a portion in which the end portion of the outer peripheral wall abuts on a sealing member of a liquid ejection apparatus is referred to as a first reference plane, a direction orthogonal to the first reference plane is referred to as a Z axis direction, a direction orthogonal to the Z axis direction is referred to as an X axis direction, a direction orthogonal to the Z axis direction and the X axis direction is referred to as a Y axis direction, and a plane including the contact portions is referred to as a second reference plane, then, the positioning portion is positioned between the end portion of the outer peripheral wall and the contact portions in the X axis direction, the positioning portion is positioned between the end portion of the outer peripheral wall and the contact portions in the Z axis direction, and the second reference plane crosses the sealing member.

14 Claims, 15 Drawing Sheets

(56) References Cited

U.S. PATENT DOCUMENTS

| | | | | |
|---|---|---|---|---|
| 2007/0040874 | A1* | 2/2007 | Matsumoto | B41J 2/17513 347/85 |
| 2008/0049081 | A1* | 2/2008 | Hayashi | B41J 2/17513 347/86 |
| 2011/0148996 | A1* | 6/2011 | Kucmerowski | B41J 2/17506 347/84 |
| 2011/0242209 | A1* | 10/2011 | Yazawa | B41J 2/1752 347/37 |
| 2013/0182047 | A1 | 7/2013 | Nozawa et al. | |
| 2013/0182052 | A1 | 7/2013 | Matsuzaki et al. | |
| 2014/0009539 | A1* | 1/2014 | Nozawa | B41J 2/17553 347/86 |
| 2014/0240411 | A1* | 8/2014 | Oya | B41J 2/1752 347/86 |
| 2015/0165775 | A1* | 6/2015 | Oya | B41J 2/1752 347/85 |
| 2015/0284159 | A1* | 10/2015 | Yamada | B41J 2/17533 220/729 |

FOREIGN PATENT DOCUMENTS

| | | | |
|---|---|---|---|
| EP | 2 883 703 | A1 | 6/2015 |
| JP | 2013-141805 | A | 7/2013 |
| JP | 2013141804 | A | 7/2013 |
| JP | 2013-163371 | A | 8/2013 |
| JP | 2014-014948 | A | 1/2014 |

* cited by examiner

LIQUID SUPPLY UNIT

BACKGROUND

1. Technical Field

The present invention relates to a liquid supply unit.

2. Related Art

Cartridges for supplying ink to printing devices are widely used. JP-A-2013-141804 discloses a structure in which a cartridge is positioned in a printing device by a projection-like restriction portion of the printing device being fit between a pair of restriction walls of the cartridge when the cartridge is mounted to the printing device.

JP-A-2013-141804 is an example of related art.

SUMMARY

In the printing device described in JP-A-2013-141804, the restriction walls of the cartridge are located near an electrode (terminal) of the cartridge. Therefore, it is possible to improve the accuracy of the contact position of the electrode of the cartridge and an electrode of the printing device. However, the restriction walls are separated from a printing material supply port of the cartridge, and thus there is a possibility that the accuracy of the contact position of the printing material supply port and a liquid introduction unit of the printing device will be insufficient. Therefore, there is demand for a technique that can improve the accuracy of both the contact position of the supply port of the cartridge with the printing device and the contact position of the electrode of the cartridge with the printing device. Such a problem is common not only to printing devices and cartridges, but also to liquid ejection apparatuses for ejecting liquid and liquid supply units that are mounted to liquid ejection apparatuses.

The present invention has been made in order to solve at least a portion of the above-described problem, and can be realized as the following aspects.

1. According to one aspect of the present invention, a liquid supply unit configured to be mounted to a liquid ejection apparatus provided with a sealing member, a projection and an electrode part is provided. This liquid supply unit includes: a liquid supply part configured to supply liquid to the liquid ejection apparatus; an outer peripheral wall that surrounds the liquid supply part and abuts on the sealing member; a plurality of contact portions that come into contact with the electrode part; and a positioning portion that is fitted with the projection. When a plane including a portion in which an end portion of the outer peripheral wall abuts on the sealing member is referred to as a first reference plane, a direction orthogonal to the first reference plane is referred to as a Z axis direction, a direction orthogonal to the Z axis direction is referred to as an X axis direction, a direction orthogonal to the Z axis direction and the X axis direction is referred to as a Y axis direction, and a plane including the plurality of contact portions is referred to as a second reference plane, then, in planar view of the liquid supply unit in the Z axis direction, the positioning portion is positioned between the end portion of the outer peripheral wall and the plurality of contact portions in the X axis direction, while in planar view of the liquid supply unit in the X axis direction, the positioning portion is positioned between the end portion of the outer peripheral wall and the plurality of contact portions in the Z axis direction, and the second reference plane crosses the sealing member. According to the liquid supply unit in such an aspect, it is possible to improve the accuracy of both the contact position of the liquid supply port and the contact position of the contact portions with the liquid ejection apparatus.

2. In the liquid supply unit of the above aspect, in planar view of the liquid supply unit in the Z axis direction, the positioning portion may be closer to any one of the plurality of contact portions than to the end portion of the outer peripheral wall in the X axis direction. According to such an aspect, it is possible to improve the accuracy of both the contact position of the liquid supply port of the liquid supply unit and the contact position of the contact portions with the liquid ejection apparatus.

3. In the liquid supply unit of the above aspect, in planar view of the liquid supply unit in the X axis direction, the positioning portion may be closer to the end portion of the outer peripheral wall than to the plurality of contact portions in the Z axis direction. According to such an aspect, it is possible to improve the accuracy of both the contact position of the liquid supply port and the contact position of the contact portions with the liquid ejection apparatus.

4. The liquid supply unit of the above aspect further includes a first wall portion on which the liquid supply part is formed; a second wall portion that opposes the first wall portion; a third wall portion that intersects the first wall portion and the second wall portion; a fourth wall portion that intersects the first wall portion and the second wall portion and opposes the third wall portion; a fifth wall portion that intersects the first wall portion, the second wall portion, the third wall portion and the fourth wall portion; a sixth wall portion that intersects the first wall portion, the second wall portion, the third wall portion and the fourth wall portion, and opposes the fifth wall portion; and a seventh wall portion that intersects the fifth wall portion and the sixth wall portion, and is positioned between the first wall portion and the fourth wall portion, wherein in planar view of the liquid supply unit in the X axis direction, the positioning portion may be positioned between a face of the first wall portion that opposes the second wall portion and the end portion of the outer peripheral wall in the Z axis direction. According to such an aspect, it is possible to improve the accuracy of the contact position of the liquid supply port with the liquid ejection apparatus.

5. In the liquid supply unit of the above aspect, in planar view of the liquid supply unit in the Z axis direction, the positioning portion may be positioned between the seventh wall portion and the end portion of the outer peripheral wall in the X axis direction. According to such an aspect, it is possible to improve the accuracy of the contact position of the liquid supply port with the liquid ejection apparatus.

6. In the liquid supply unit of the above aspect, the liquid supply part includes an opening formed in the first wall portion and a filter that covers the opening, and in planar view of the liquid supply unit in the X axis direction, the positioning portion may be positioned between the opening and the end portion of the outer peripheral wall in the Z axis direction. According to such an aspect, it is possible to increase the accuracy of the contact position of the liquid supply part with the liquid ejection apparatus.

7. In the liquid supply unit of the above aspect, a distance between the third wall portion and the fourth wall portion may be greater than a distance between the fifth wall portion and the sixth wall portion.

8. According to another aspect of the present invention, a liquid ejection apparatus provided with a sealing member, a projection and an electrode part is provided. The liquid ejection apparatus includes the liquid supply unit of the above aspects and a carriage unit to which the liquid supply unit is mounted. The carriage unit may move in the X axis direction.

9. According to a second aspect of the present invention, a liquid supply unit configured to be mounted to a liquid ejection apparatus provided with a sealing member, a projection and an electrode part is provided. This liquid supply unit includes: a first wall portion; a second wall portion that opposes the first wall portion; a third wall portion that intersects the first wall portion and the second wall portion; a fourth wall portion that intersects the first wall portion and the second wall portion and opposes the third wall portion; a fifth wall portion that intersects the first wall portion, the second wall portion, the third wall portion and the fourth wall portion; a sixth wall portion that intersects the first wall portion, the second wall portion, the third wall portion and the fourth wall portion, and opposes the fifth wall portion; and a seventh wall portion that intersects the fifth wall portion and the sixth wall portion, and is positioned between the first wall portion and the fourth wall portion. Moreover, the first wall portion is provided with a liquid supply part configured to supply a liquid to the liquid ejection apparatus, an outer peripheral wall that surrounds the liquid supply part and abuts on the sealing member, and a positioning portion that is fitted with the projection, and the seventh wall portion is provided with a plurality of contact portions that come into contact with the electrode part. The first wall portion, the second wall portion, the third wall portion, the fourth wall portion, the fifth wall portion, the sixth wall portion and the seventh wall portion surround a liquid container that communicates with the liquid supply part, and a plane including a face on a liquid container side of the seventh wall portion crosses the liquid supply part. According to the liquid supply unit of such an aspect, it is possible to improve the accuracy of both the contact position of the liquid supply port and the contact position of the contact portions with the liquid ejection apparatus.

10. According to a third aspect of the present invention, a liquid supply unit configured to be mounted to a liquid ejection apparatus provided with a sealing member, a projection and an electrode part is provided. This liquid supply unit includes a first wall portion; a second wall portion that opposes the first wall portion; a third wall portion that intersects the first wall portion and the second wall portion; a fourth wall portion that intersects the first wall portion and the second wall portion and opposes the third wall portion; a fifth wall portion that intersects the first wall portion, the second wall portion, the third wall portion and the fourth wall portion; a sixth wall portion that intersects the first wall portion, the second wall portion, the third wall portion and the fourth wall portion and opposes the fifth wall portion; a seventh wall portion that intersects the fifth wall portion and the sixth wall portion and is positioned between the first wall portion and the fourth wall portion; and a substrate provided on the seventh wall portion. Moreover, the first wall portion is provided with a liquid supply part configured to supply a liquid to the liquid ejection apparatus, an outer peripheral wall that surrounds the liquid supply part and abuts on the sealing member, and a positioning portion that is fitted with the projection, and the substrate is provided with a plurality of contact portions that come into contact with the electrode part. The first wall portion, the second wall portion, the third wall portion, the fourth wall portion, the fifth wall portion, the sixth wall portion and the seventh wall portion surround a liquid container that communicates with the liquid supply part, and a plane including a face on a substrate side of the seventh wall portion crosses the sealing member. According to the liquid supply unit of such an aspect, it is possible to improve the accuracy of both the contact position of the liquid supply port and the contact position of the contact portions with the liquid ejection apparatus.

11. According to a fourth aspect of the present invention, a liquid supply unit configured to be mounted to a liquid ejection apparatus provided with a sealing member, a projection and an electrode part is provided. This liquid supply unit includes a first wall portion; a second wall portion that opposes the first wall portion; a third wall portion that intersects the first wall portion and the second wall portion; a fourth wall portion that intersects the first wall portion and the second wall portion and opposes the third wall portion; a fifth wall portion that intersects the first wall portion, the second wall portion, the third wall portion and the fourth wall portion; a sixth wall portion that intersects the first wall portion, the second wall portion, the third wall portion and the fourth wall portion, and opposes the fifth wall portion; a seventh wall portion that intersects the fifth wall portion and the sixth wall portion, and is positioned between the first wall portion and the fourth wall portion; and a substrate placed on the seventh wall portion. Moreover, the first wall portion is provided with a liquid supply part configured to supply a liquid to the liquid ejection apparatus, an outer peripheral wall that surrounds the liquid supply part and abuts on the sealing member, and a positioning portion that is fitted with the projection, and the substrate is provided with a plurality of contact portions that come into contact with the electrode part. The first wall portion, the second wall portion, the third wall portion, the fourth wall portion, the fifth wall portion, the sixth wall portion and the seventh wall portion surround a liquid container that communicates with the liquid supply part, and a plane including the plurality of contact portions crosses the sealing member. According to the liquid supply unit of such an aspect, it is possible to improve the accuracy of both the contact position of the liquid supply port and the contact position of the contact portions with the liquid ejection apparatus.

12. In the liquid supply unit of the above aspect, a distance between the third wall portion and the fourth wall portion may be greater than a distance between the fifth wall portion and the sixth wall portion.

13. According to yet another aspect of the present invention, a liquid ejection apparatus provided with a sealing member, a projection and an electrode part is provided. The liquid ejection apparatus includes the liquid supply unit of the above aspects and a carriage unit to which the liquid supply unit is mounted. The carriage unit may move in a direction from the third wall portion toward the fourth wall portion.

The present invention can be achieved in various aspects besides an aspect as the above-described liquid supply unit. For example, the present invention can be achieved in aspects as a liquid ejection apparatus, a liquid supply system, a cartridge, a printing device and the like.

BRIEF DESCRIPTION OF THE DRAWINGS

The invention will be described with reference to the accompanying drawings, wherein like numbers reference like elements.

DESCRIPTION OF EXEMPLARY EMBODIMENTS

A. Embodiment

Figure 1:
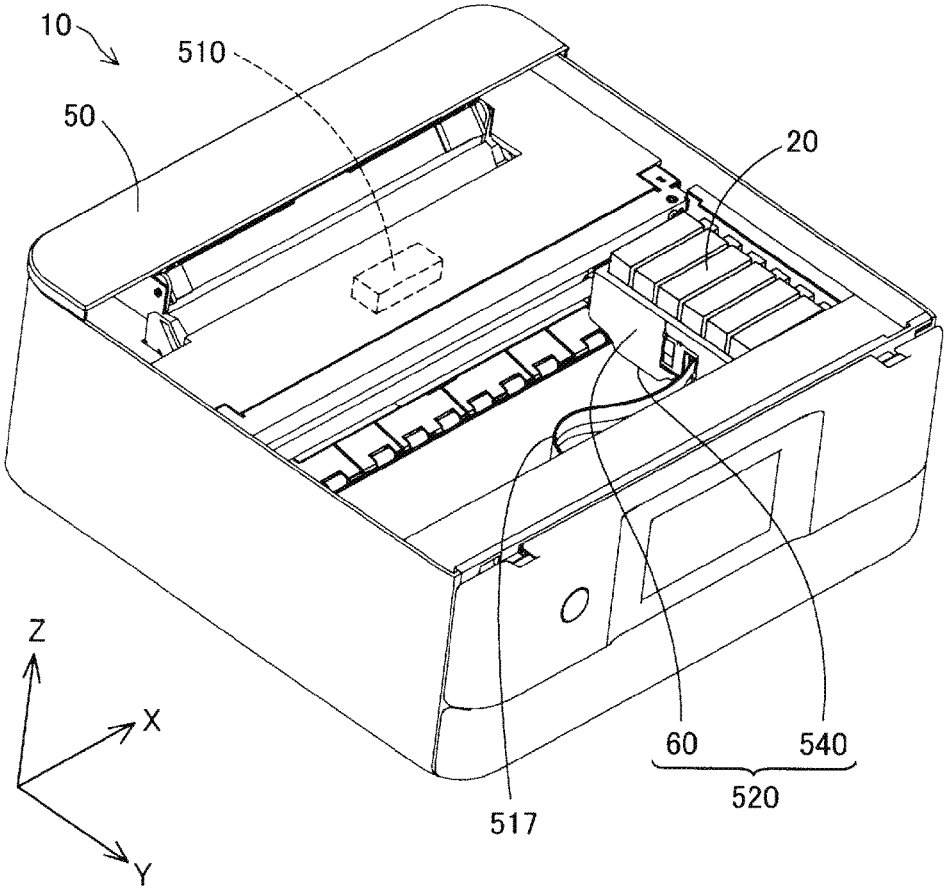
FIG. 1 is a perspective view showing a schematic configuration of a liquid supply system.

FIG. 1 is a perspective view showing the schematic configuration of a liquid supply system 10. In FIG. 1, X, Y and Z axes that are orthogonal to each other are illustrated. The X, Y and Z axes in FIG. 1 are the same as X, Y and Z axes in other figures. The liquid supply system 10 is provided with a cartridge 20 serving as a liquid supply unit and a printer 50 serving as a liquid ejection apparatus. In the liquid supply system 10, the cartridge 20 is removably mounted by the user to a holder 60 of the printer 50. For example, the printer 50 is provided with a sealing member, a projection and an electrode part, as will be described later.

The cartridge 20 of the liquid supply system 10 contains ink as serving a printing material (liquid). The ink contained in the cartridge 20 is supplied to a head 540 via a liquid supply part and a liquid introduction unit, which will be described later. In this embodiment, a plurality of cartridges 20 are removably mounted to the holder 60 of the printer 50. In this embodiment, six types of cartridges 20 in one-to-one correspondence with ink of six colors (black, yellow, magenta, light magenta, cyan and light cyan), that is, six cartridges 20 in total are mounted to the holder 60.

In another embodiment, the number of cartridges that are mounted to the holder 60 may be six or less, or may be six or more. In another embodiment, the number of types of ink for the cartridge 20 may be six or less, or may be six or more. In another embodiment, two or more cartridges 20 for ink of one color may be mounted to the holder 60. The detailed configurations of the cartridge 20 and the holder 60 will be described later.

The printer 50 is a small-sized inkjet printer for personal use. The printer 50 is provided with, in addition to the holder 60, a control unit 510 and a carriage unit 520 having the holder 60. The carriage unit 520 is provided with the head 540. The printer 50 causes ink to flow from the cartridge 20 mounted in the holder 60 to the head 540 via the liquid introduction unit that will be described later, and discharges (supplies) the ink from the head 540 to a printing medium such as a sheet or a label. Accordingly, data such as characters, graphics and images are printed onto the printing medium using the head 540.

The control unit 510 of the printer 50 controls each constituent element of the printer 50. The carriage unit 520 of the printer 50 is configured to be able to move the head 540 relative to a printing medium. The head 540 of the printer 50 is provided with an ink discharge mechanism for discharging ink contained in the cartridge 20 to a printing medium. The control unit 510 and the carriage unit 520 are electrically connected via a flexible cable 517, and the ink discharge mechanism of the head 540 is operated based on control signals from the control unit 510.

In this embodiment, the holder 60 as well as the head 540 are formed on the carriage unit 520. The type of the printer 50 in which the cartridge 20 is mounted to the holder 60 on the carriage unit 520 that moves the head 540 as described above is referred to as an "on-carriage type". In another embodiment, a configuration may be adopted in which the holder 60 that is immovable is formed at a position that is different from the position of the carriage unit 520, and ink from the cartridge 20 mounted in the holder 60 is supplied to the head 540 of the carriage unit 520 via a flexible tube. The type of such a printer is referred to as an "off-carriage type".

In this embodiment, the printer 50 is provided with a main scanning feeding mechanism and a sub scanning feeding mechanism for realizing printing on a printing medium by relatively moving the carriage unit 520 and the printing medium. The main scanning feeding mechanism of the printer 50 is provided with a carriage motor and a driving belt, and reciprocally moves the carriage unit 520 in a main scanning direction by transmitting the motive power of the carriage motor to the carriage unit 520 via the driving belt. The sub scanning feeding mechanism of the printer 50 is provided with a conveyance motor and a platen, and conveys a printing medium in a sub-scanning direction orthogonal to the main scanning direction by transmitting the motive power of the conveyance motor to the platen. The carriage motor of the main scanning feeding mechanism and the conveyance motor of the sub scanning feeding mechanism are operated based on control signals from the control unit 510.

In this embodiment, in a usage state of the liquid supply system 10 (also referred to as a "usage orientation"), an axis along the sub-scanning direction (the front-rear direction) in which a printing medium is conveyed is referred to as a Y axis, an axis along the main scanning direction (the right-left direction) in which the carriage unit 520 is reciprocally moved is referred to as an X axis, and an axis along the gravity direction (the up-down direction) is referred to as a Z axis. Note that the usage state of the liquid supply system 10 is a state in which the liquid supply system 10 is installed on the horizontal plane, and in this embodiment, the horizontal plane is a plane parallel to the X axis and the Y axis (an XY plane).

In this embodiment, the sub-scanning direction (the forward direction) is referred to as a +Y axis direction and the opposite direction (the backward direction) is referred to as a −Y axis direction, and a direction upward from below in the gravity direction (the upward direction) is referred to as a +Z axis direction and the opposite direction (the downward direction) is referred to as a −Z axis direction. In this embodiment, a +Y axis direction side is in front of the liquid supply system 10. In this embodiment, a direction from the left side face toward the right side face of the liquid supply system 10 is referred to as a +X axis direction (the right direction), and the opposite direction is referred to as a −X axis direction (the left direction). In this embodiment, the alignment direction of a plurality of cartridges 20 mounted to the holder 60 is a direction along the Y axis (the front-rear direction, simply referred to as a "Y axis direction" as well). Note that a direction along the X axis (the right-left direction) is also referred to as an "X axis direction", and a direction along the Z axis (the up-down direction) is also referred to as a "Z axis direction".

Figure 2:
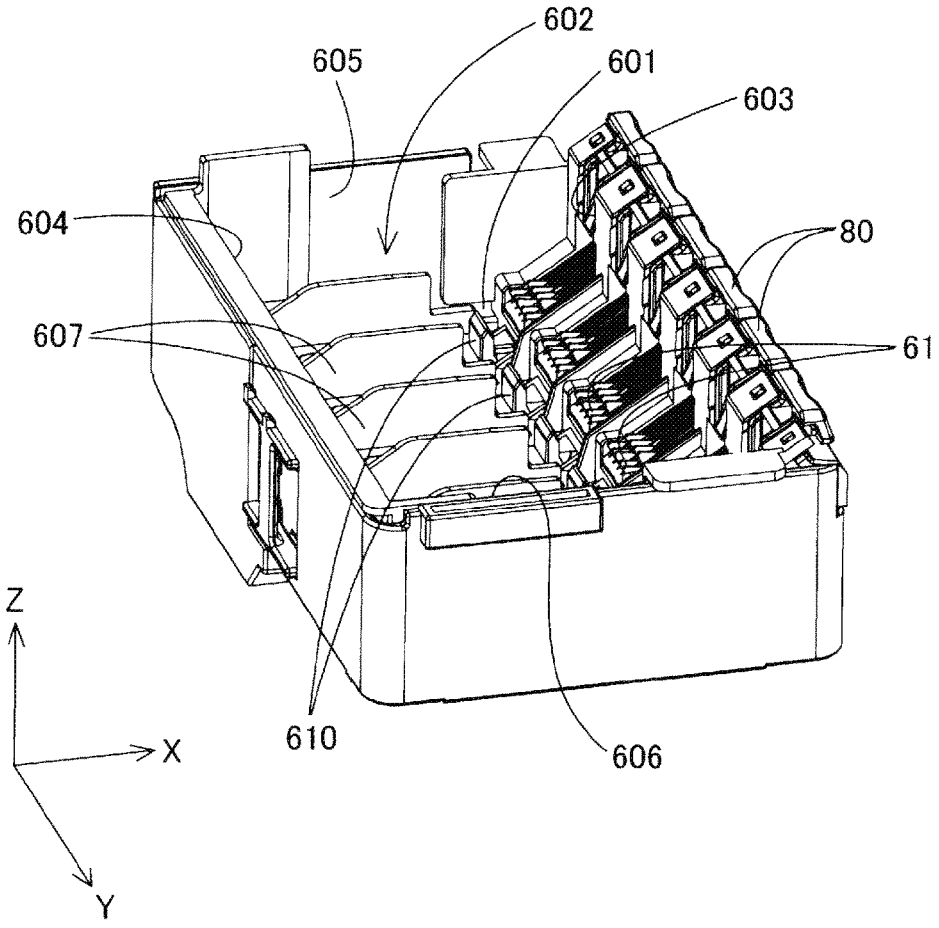
FIG. 2 is a first perspective view of a holder.
Figure 3:
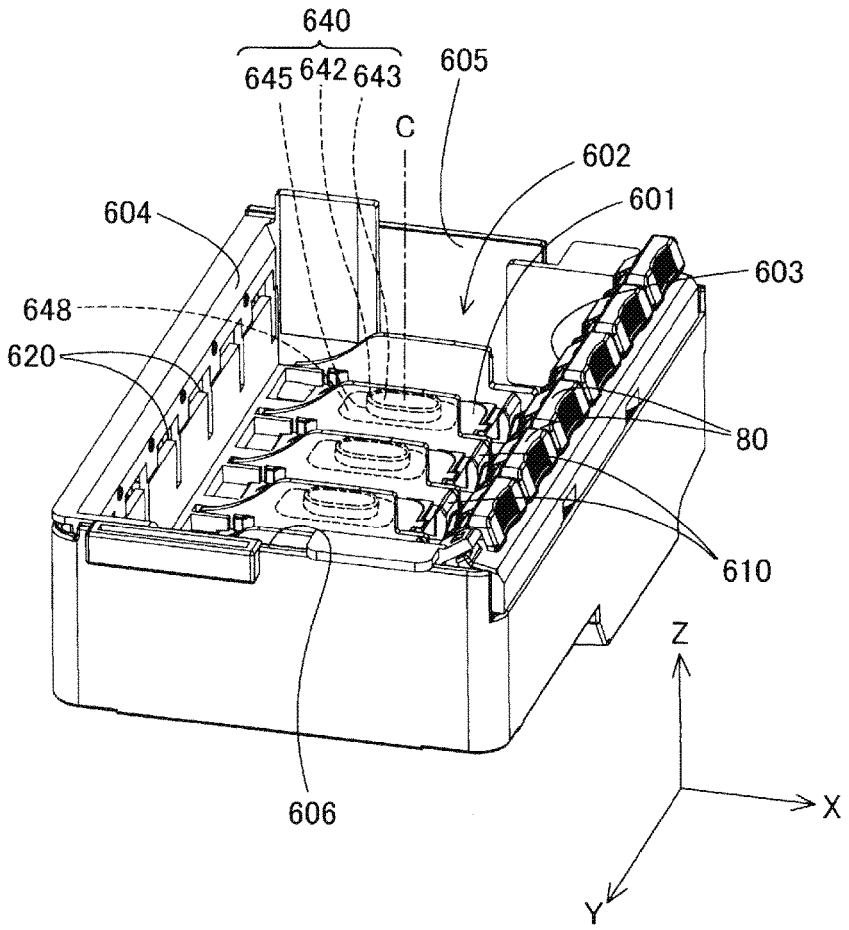
FIG. 3 is a second perspective view of the holder.
Figure 4:
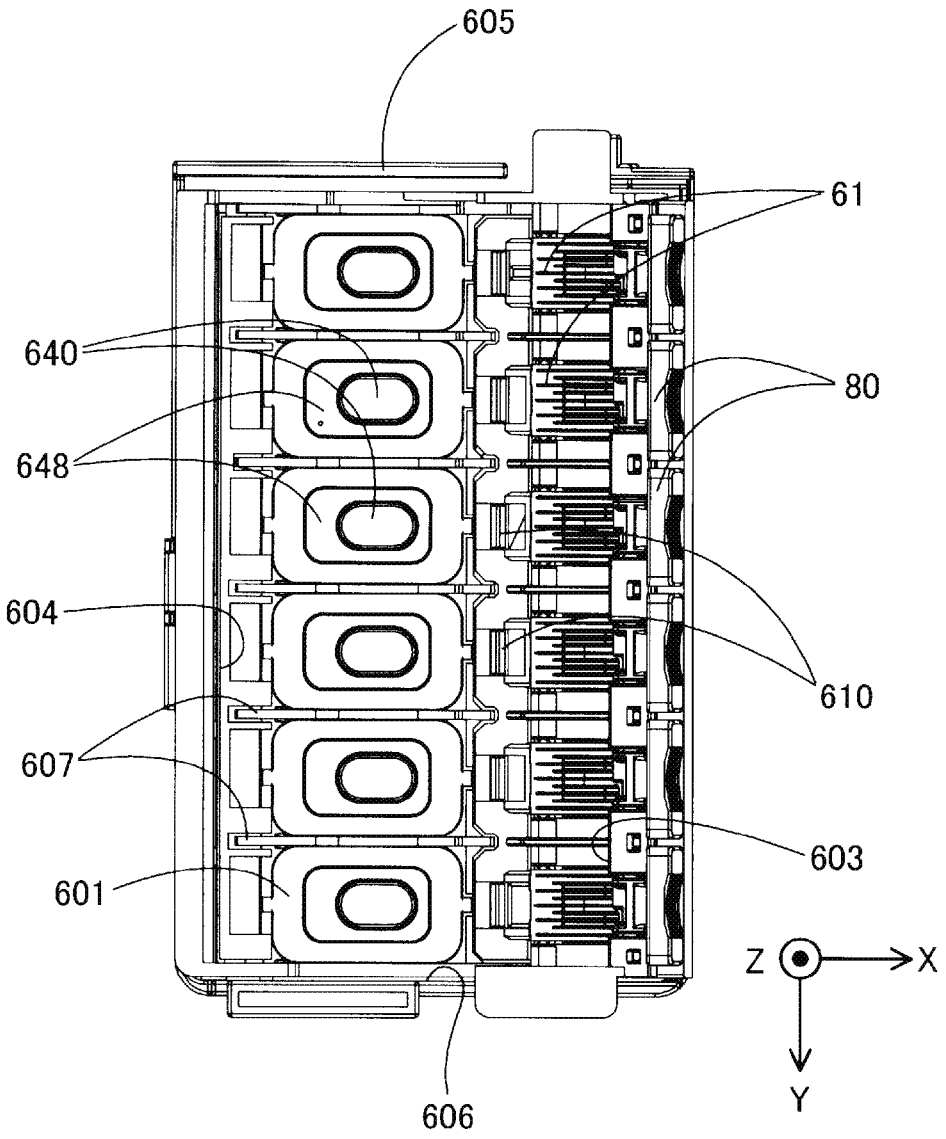
FIG. 4 is a plan view of the holder viewed from a +Z axis direction side.

FIG. 2 is a first perspective view of the holder 60. FIG. 3 is a second perspective view of the holder 60. FIG. 4 is a plan view of the holder 60 as viewed from the +Z axis direction side.

As shown in FIGS. 2 to 4, the holder 60 has five wall portions 601, 603, 604, 605 and 606. A recess portion formed by these five wall portions serves as a cartridge housing chamber 602 (also referred to as a "cartridge mounting part 602"). Hereinafter, the wall portion 601 is also referred to as a bottom wall portion 601. The cartridge housing chamber 602 is divided by partitions 607 into a plurality of slots (mounting spaces) that can respectively accommodate the cartridges 20. The partitions 607 function as guides for inserting the cartridges 20 into the slots. A liquid introduction unit 640, an electrode part 61, a lever 80, a projection 610, and a restriction portion 620 of the apparatus (FIG. 3) are provided for each of the slots. One face (a face in the +Z axis direction, namely, a top face) of each of the slots is open, and the cartridge 20 is mounted/removed to/from the holder 60 via this one open face (top face). The liquid introduction unit 640 is provided so as to be sandwiched between two partitions 607.

The projection 610 is a substantially rectangular parallelepiped member that protrudes from the bottom wall portion 601 in the +Z axis direction. The projection 610 is inserted into a positioning portion provided on the cartridge 20. In order to make it easy to insert the projection 610 of the cartridge 20 into the positioning portion, the faces of a tip portion of the projection 610 on a +X axis direction side and on a −X axis direction side are inclined to be closer to each other toward the tip.

The cartridge 20 is mounted to the holder 60 by being locked by the lever 80 and the restriction portion 620 of the apparatus and the liquid supply part to be described later being connected to the liquid introduction unit 640. At this time, the cartridge 20 is positioned in the cartridge housing chamber 602 by the projection 610. This state is also referred to as a "state in which the cartridge 20 is mounted to the holder 60" or as a "mounted state". In the mounted state, a group of terminals provided on a circuit substrate (to be described later) of the cartridge 20 is electrically connected to the electrode part 61, whereby various types of information is transmitted between the cartridge 20 and the printer 50.

The liquid introduction unit 640 circulates ink contained in the cartridge 20 to the head 540 by being connected to the liquid supply part of the cartridge 20 in the mounted state. The liquid introduction unit 640 is substantially cylindrical, and has a top end portion 642 positioned on the +Z axis side, and a base end portion 645 positioned on the −Z axis side. The base end portion 645 is provided on the bottom wall portion 601. The top end portion 642 is connected to the liquid supply part of the cartridge 20. A filter 643 of the apparatus is provided on the top end portion 642. Ink flows from the liquid supply part of the cartridge 20 into the liquid introduction unit 640 through the filter 643 of the apparatus. The filter 643 of the apparatus is formed by a porous member such as a metal mesh filter, a metal nonwoven fabric filter, or a resin filter. A central axis C of the liquid introduction unit 640 is parallel to the Z axis. A direction along the central axis C from the base end portion 645 toward the top end portion 642 is the +Z axis direction.

As shown in FIGS. 3 and 4, a sealing member 648 is provided on the periphery of the liquid introduction unit 640. The sealing member 648 is formed by elastic rubber, for example. In the mounted state, the sealing member 648 seals the liquid supply part of the cartridge 20 at its periphery. Accordingly, the sealing member 648 prevents ink from leaking from the liquid supply part to the surroundings. In the mounted state, the sealing member 648 applies a biasing force including a +Z axis direction component to the cartridge 20.

Figure 5:
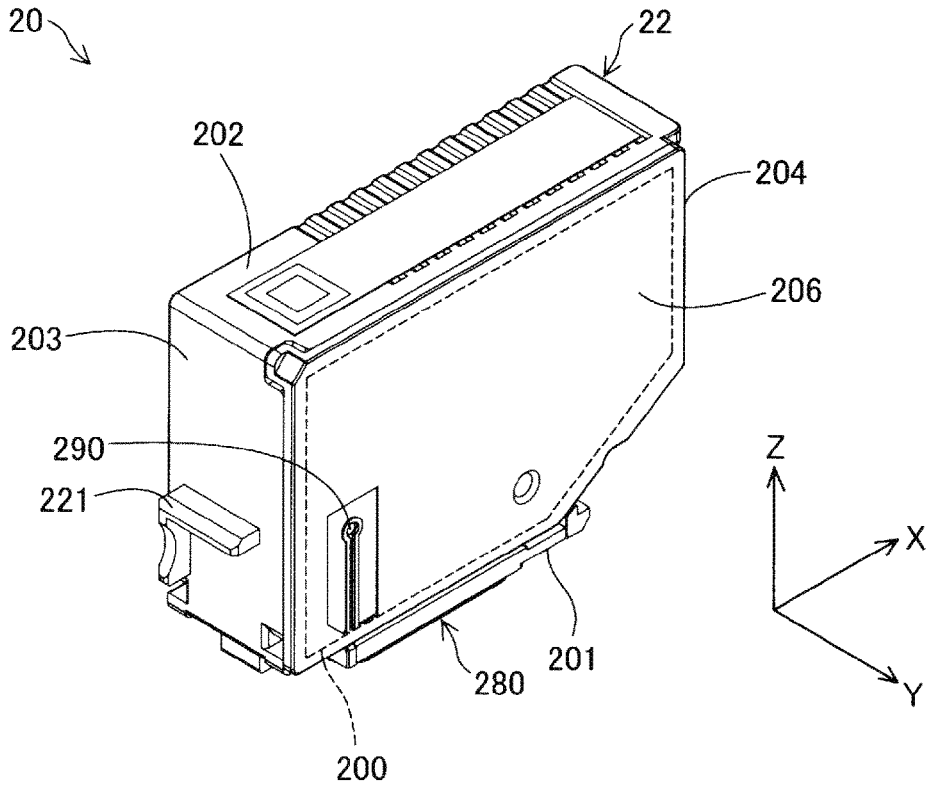
FIG. 5 is a first external perspective view of a cartridge.
Figure 6:
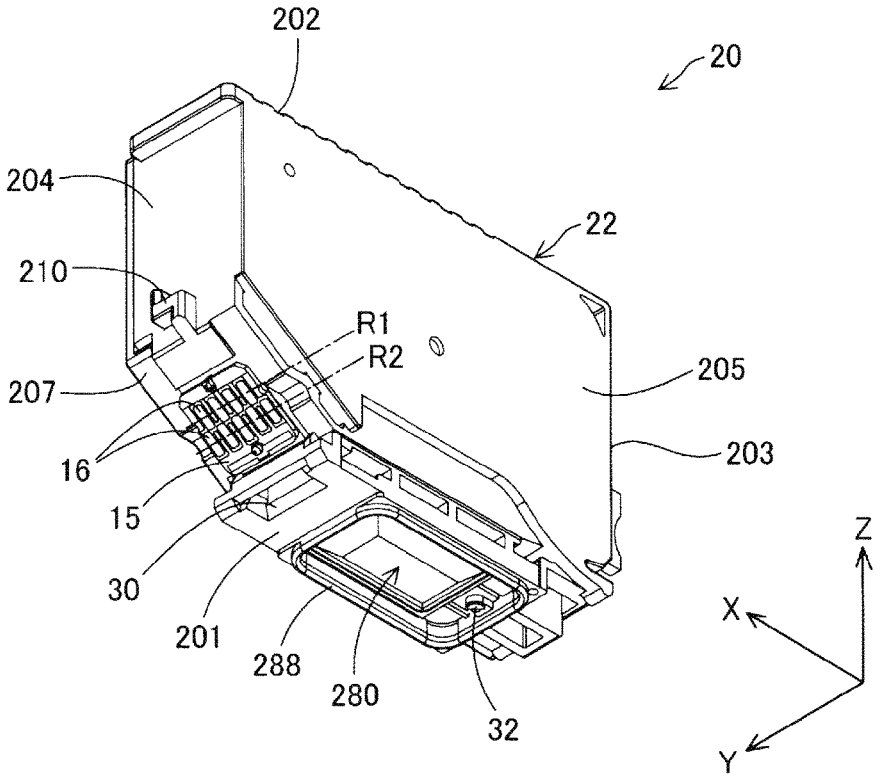
FIG. 6 is a second external perspective view of the cartridge.
Figure 7:
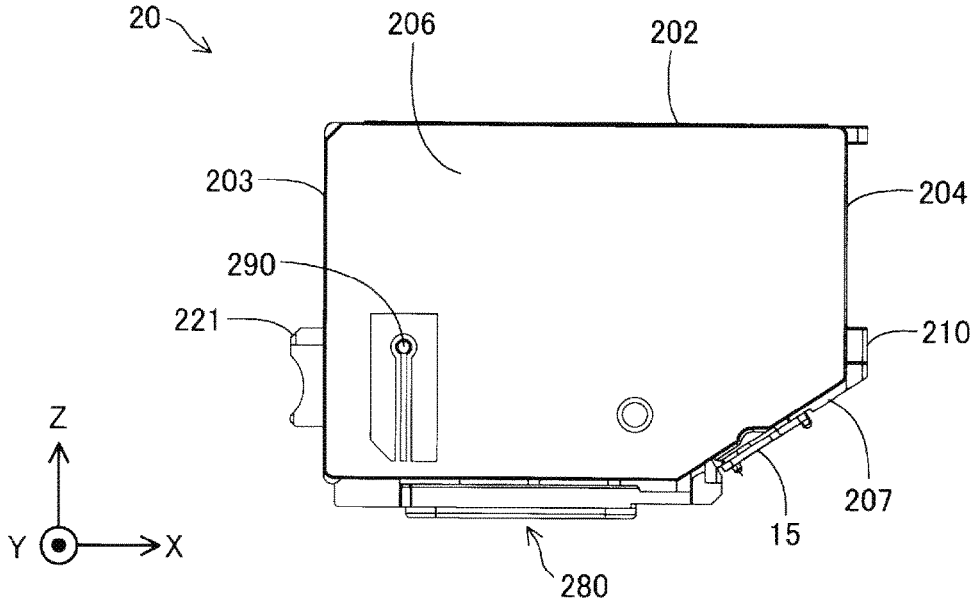
FIG. 7 is a front view of the cartridge.
Figure 8:
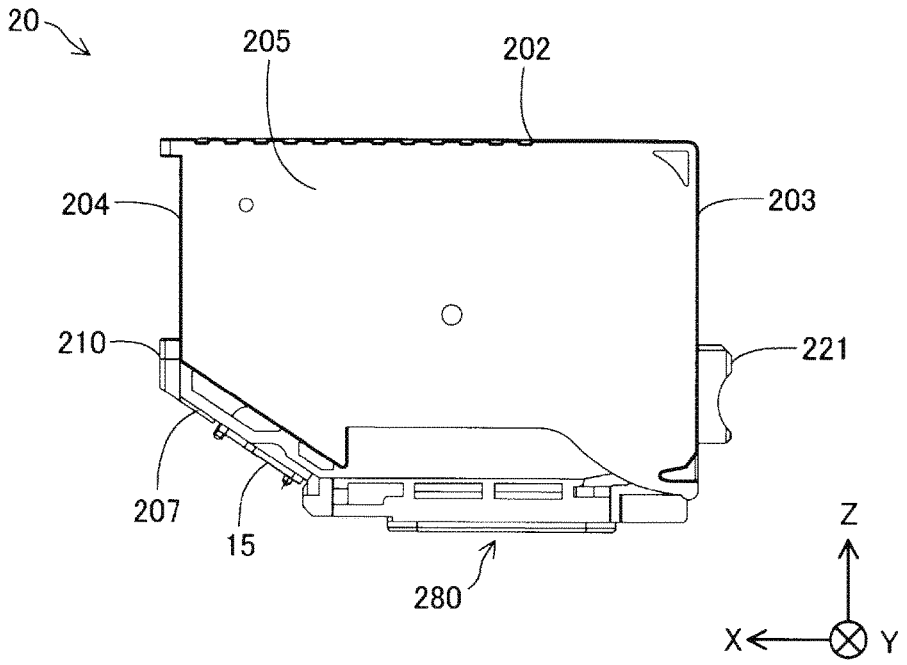
FIG. 8 is a rear view of the cartridge.
Figure 9:
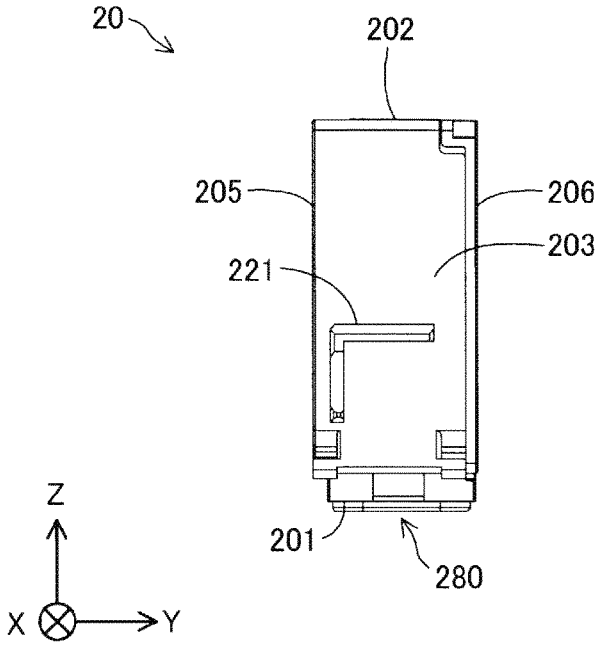
FIG. 9 is a left side view of the cartridge.
Figure 10:
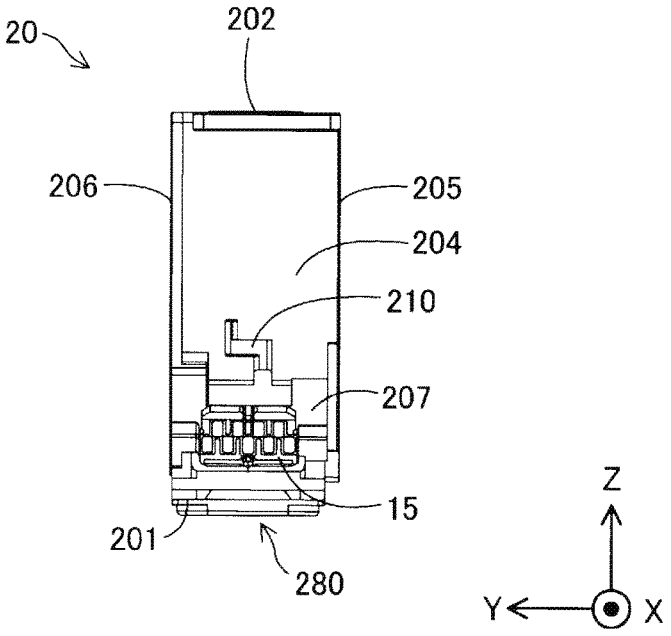
FIG. 10 is a right side view of the cartridge.
Figure 11:
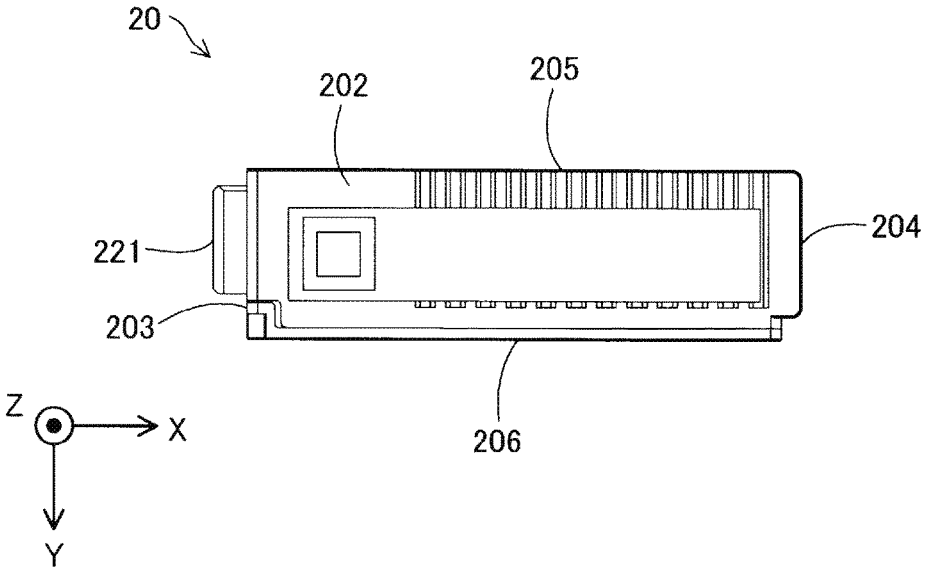
FIG. 11 is a plan view of the cartridge.
Figure 12:
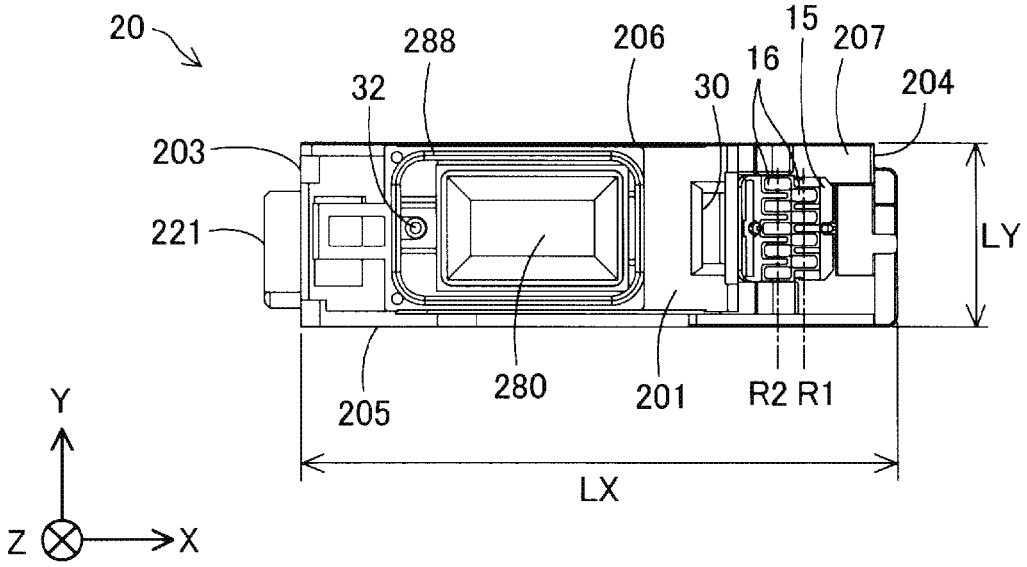
FIG. 12 is a bottom view of the cartridge.

FIG. 5 is a first external perspective view of the cartridge 20. FIG. 6 is a second external perspective view of the cartridge 20. FIG. 7 is a front view of the cartridge 20. FIG. 8 is a rear view of the cartridge 20. FIG. 9 is a left side view of the cartridge 20. FIG. 10 is a right side view of the cartridge 20. FIG. 11 is a plan view of the cartridge 20. FIG. 12 is a bottom view of the cartridge 20. The cartridge 20 of this embodiment is a so-called semi-sealed type cartridge that intermittently introduces external air into a liquid container 200 in accordance with the ink consumption.

The cartridge 20 is provided with the liquid container 200 (FIG. 5) for containing ink therein, a liquid supply part 280 (FIG. 6) for supplying the ink in the liquid container 200 to the printer 50, an outer peripheral wall 288 (FIG. 6) that surrounds the liquid supply part 280 and abuts on the sealing member 648 of the holder 60, a plurality of contact portions 16 (FIG. 6) that come into contact with the electrode part 61 of the holder 60, and a positioning portion 30 (FIG. 6) that fits with the projection 610 of the holder 60.

As shown in FIGS. 5 and 6, the cartridge 20 has an outer shell 22 that is substantially rectangular parallelepiped-shaped. The outer shell 22 has seven wall portions 201 to 207. The seven wall portions consist of the first wall portion 201 (bottom wall 201), the second wall portion 202 (upper wall 202), the third wall portion 203 (one end wall 203), the fourth wall portion 204 (the other end wall 204), the fifth wall portion 205 (one side wall 205), the sixth wall portion 206 (the other side wall 206) and the seventh wall portion 207 (inclined wall 207). The first wall portion 201, the second wall portion 202, the third wall portion 203, the fourth wall portion 204, the fifth wall portion 205, the sixth wall portion 206 and the seventh wall portion 207 surround the liquid container 200 that communicates with the liquid supply part 280.

In the following description, the meaning of two wall portions "crossing" or "intersecting" each other includes any of a state in which the two wall portions are connected with and cross each other, a state in which an extension plane of one of the wall portions crosses the other wall portion, and a state in which extension planes of the wall portions cross each other. Moreover, the meaning of two wall portions "opposing" each other includes both a case in which another object is not present between the two wall portions and a case in which another object is present.

The outer surfaces of the wall portions 201 to 207 are generally flat. The meaning of "generally flat" includes a case in which an entire surface is completely flat and a case in which a portion of a surface includes roughness. Accordingly, a case is included in which, even if a portion of a surface includes slight roughness, surfaces and walls that constitute the outer shell 22 of the cartridge 20 can be recognized. In planar view, the outer shapes of the first wall portion 201 to the seventh wall portion 207 are all rectangular. In this embodiment, the first wall portion 201 to the seventh wall portion 207 may be the outer surfaces of an assembly obtained by assembling a plurality of members. In this embodiment, the first wall portion 201 to the seventh wall portion 207 are plate-like. In another embodiment, the first wall portion 201 to the seventh wall portion 207 may be partially formed by a film-like (thin film-like) member. The first wall portion 201 to the seventh wall portion 207 are formed by synthetic resin such as polyacetal (POM).

As shown in FIGS. 5 and 6, the first wall portion 201 and the second wall portion 202 are wall portions that are parallel to the X axis and the Y axis. The second wall portion 202 opposes the first wall portion 201. In other words, the first wall portion 201 and the second wall portion 202 oppose each other in the Z axis direction. The first wall portion 201 is positioned on the −Z axis direction side, and the second wall portion 202 is positioned on the +Z axis direction side. The first wall portion 201 and the second wall portion 202 are in a positional relationship of crossing the third wall portion 203, the fourth wall portion 204, the fifth wall portion 205 and the sixth wall portion 206. In this embodiment, in the mounted state in which the cartridge 20 is mounted to the holder 60, the first wall portion 201 constitutes the bottom face of the cartridge 20, and the second wall portion 202 constitutes the top face of the cartridge 20. The liquid supply part 280, the outer peripheral wall 288 and the positioning portion 30 are provided on the first wall portion 201.

The third wall portion 203 and the fourth wall portion 204 are wall portions that are parallel to the Y axis and the Z axis. The third wall portion 203 and the fourth wall portion 204 oppose each other in the X axis direction. The third wall portion 203 is positioned on the −X axis direction side, and the fourth wall portion 204 is positioned on the +X axis direction side. The third wall portion 203 intersects the first wall portion 201 and the second wall portion 202. The fourth wall portion 204 intersects the first wall portion 201 and the second wall portion 202, and opposes the third wall portion 203. As described earlier, in this embodiment, the carriage unit 520 reciprocally moves in the X axis direction. Accordingly, the direction of movement of the carriage unit 520 is a direction from the third wall portion 203 toward the fourth wall portion 204, or a direction from the fourth wall portion 204 toward the third wall portion 203.

The fifth wall portion 205 and the sixth wall portion 206 are wall portions that are parallel to the X axis and the Z axis. The fifth wall portion 205 and the sixth wall portion 206 oppose each other in the Y axis direction. The fifth wall portion 205 intersects the first wall portion 201, the second wall portion 202, the third wall portion 203 and the fourth wall portion 204. The sixth wall portion 206 intersects the first wall portion 201, the second wall portion 202, the third wall portion 203 and the fourth wall portion 204, and opposes the fifth wall portion 205. As shown in FIG. 5, a ventilation port 290 for introducing air into the cartridge 20 is formed in the sixth wall portion 206. In this embodiment, as shown in FIG. 12, a distance LX between the third wall portion 203 and the fourth wall portion 204 is greater than a distance LY between the fifth wall portion 205 and the sixth wall portion 206.

As shown in FIG. 6, the positioning portion 30 that is recessed in the +Z axis direction is provided at the end portion of the first wall portion 201 on the seventh wall portion 207 side. Specifically, the positioning portion 30 is arranged between the liquid supply part 280 arranged on the first wall portion 201 and a substrate 15 arranged on the seventh wall portion 207. The positioning portion 30 is a recess portion provided in the first wall portion 201. In the mounted state, the projection 610 provided on the holder 60 is inserted and fitted into the positioning portion 30. Accordingly, the cartridge 20 is positioned in the holder 60.

As shown in FIGS. 6 and 10, a first restriction portion 210 of the cartridge (a rib 210 on one side) is formed on the fourth wall portion 204. The first restriction portion 210 of the cartridge is a projection provided so as to protrude from the fourth wall portion 204. In the mounted state, the first restriction portion 210 of the cartridge is locked by the lever 80. As shown in FIGS. 5 and 9, a second restriction portion 221 of the cartridge (a rib 221 on the other side) is formed on the third wall portion 203. The second restriction portion 221 of the cartridge is a projection provided so as to protrude from the third wall portion 203. In the mounted state, the second restriction portion 221 of the cartridge is inserted into and locked by the restriction portion 620 of the apparatus, which is a hole formed in a wall portion 604 of the holder 60 (FIG. 3). Accordingly, in the mounted state, the cartridge 20 is locked by the lever 80 of the holder 60 and the restriction portion 620 of the apparatus respectively on the +X axis direction side and the −X axis direction side, whereby the cartridge 20 is fixed to the holder 60.

As shown in FIG. 6, the seventh wall portion 207 is a wall portion that connects the first wall portion 201 and the fourth wall portion 204. The seventh wall portion 207 intersects the fifth wall portion 205 and the sixth wall portion 206, and is positioned between the first wall portion 201 and the fourth wall portion 204. The substrate 15 is provided on the seventh wall portion 207. The substrate 15 has the plurality of contact portions 16 that are to come into contact with the electrode part 61 provided on the holder 60 in the mounted state. More specifically, the contact portions 16 are areas that are in terminals for electrodes provided on the surface of the substrate 15 and come into contact with the electrode part 61. In this embodiment, the plurality of contact portions 16 form a first row R1 and a second row R2 with a predetermined interval in the X axis direction, as viewed from the −Z axis direction. A storage apparatus 18 (FIG. 18) that stores various types of information regarding the cartridge 20 is provided on the back face of the substrate 15. The storage apparatus 18 stores information indicating an ink remaining state and an ink color, for example. When the electrode part 61 provided on the holder 60 is brought into contact with the contact portions 16, the control unit 510 provided in the printer 50 can read various types of information from the storage apparatus 18 provided in the cartridge 20, through the flexible cable 517.

The electrode part 61 provided on the holder 60 has elastic force, and in the mounted state, the contact portions 16 receive a repulsive force from the electrode part 61 in the +Z direction and the −X direction. Movement of the cartridge 20 in the +Z direction and the −X direction is restricted by the positioning portion 30, the first restriction portion 210 of the cartridge, and the second restriction portion 221 of the cartridge, while the contact portions 16 receive a repulsive force from the electrode part 61 in the +Z direction and the −X direction, and thereby the contact portions 16 and the electrode part 61 easily keep a contact state.

Figure 13A:
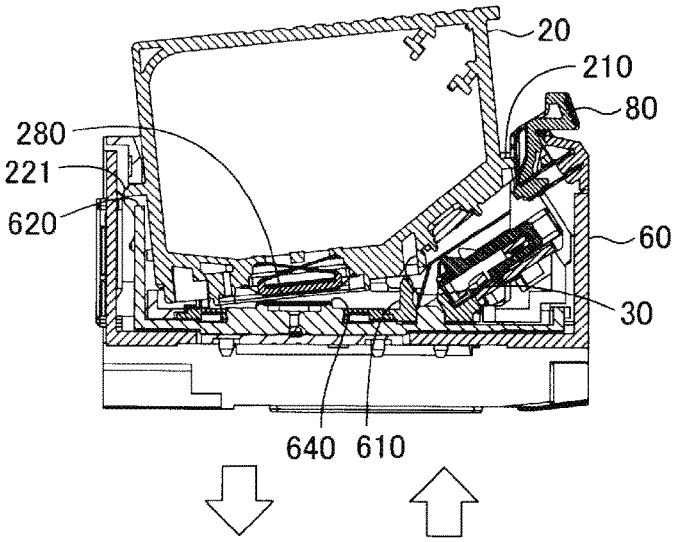
FIGS. 13A, 13B and 13C are diagrams showing a state in which the cartridge is mounted to the holder.
Figure 13B:
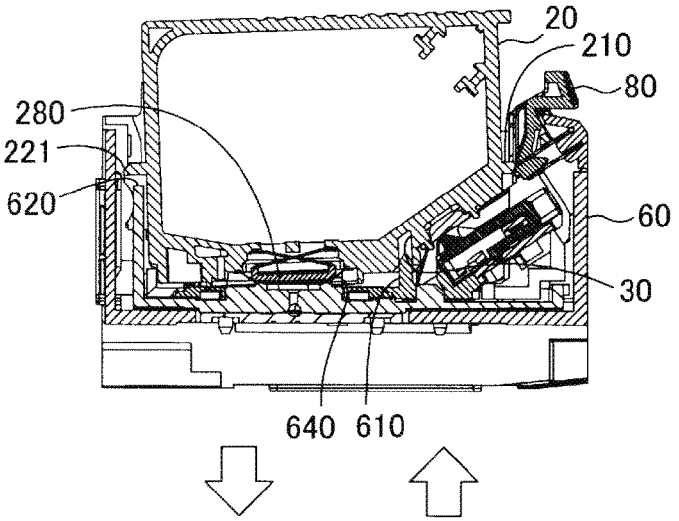
Figure 13C:
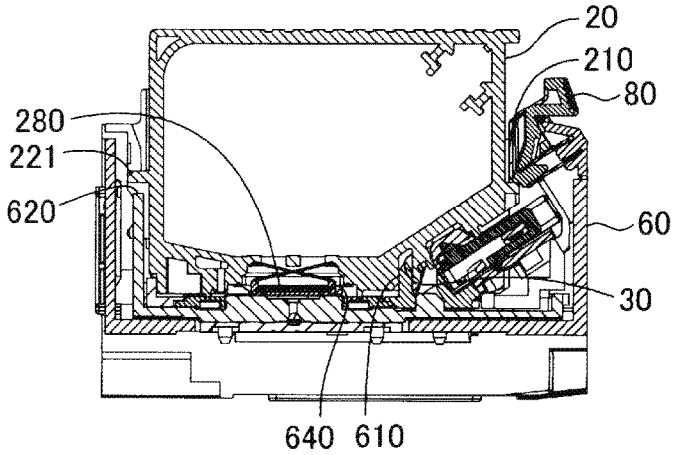

FIGS. 13A, 13B and 13C are diagrams showing a state in which the cartridge 20 is mounted to the holder 60. When the cartridge 20 is mounted to the holder 60, first, as shown in FIG. 13A, the second restriction portion 221 of the cartridge is inserted into the restriction portion 620 of the apparatus. The cartridge 20 is then inserted into the holder 60 while being rotated with respect to the vicinity in which the restriction portion 620 of the apparatus and the second restriction portion 221 of the cartridge come into contact with each other. As shown in FIG. 13B, the cartridge 20 then stops in a state where the fourth wall portion 204 of the cartridge 20 is slightly raised. Next, when, from this state, the cartridge 20 is pressed in against the repulsion force from the electrode part 61 of the holder 60, the projection 610 is inserted into the positioning portion 30, and the liquid supply part 280 and the liquid introduction unit 640 come into contact with each other. Lastly, as shown in FIG. 13C, the first restriction portion 210 of the cartridge is locked by the lever 80, and the cartridge 20 is fixed to the holder 60. When the cartridge 20 is removed from the holder 60, conversely, the locking of the lever 80 by the first restriction portion 210 of the cartridge is first released. The cartridge 20 is lifted due to the repulsion force from the electrode part 61 of the holder 60 until a state shown in FIG. 13B is entered. After that, the cartridge 20 is lifted while being rotated with respect to the vicinity in which the restriction portion 620 of the apparatus and the second restriction portion 221 of the cartridge come into contact with each other, and furthermore, the cartridge 20 is pulled out of the holder 60, whereby the cartridge 20 is removed from the holder 60.

Figure 14:
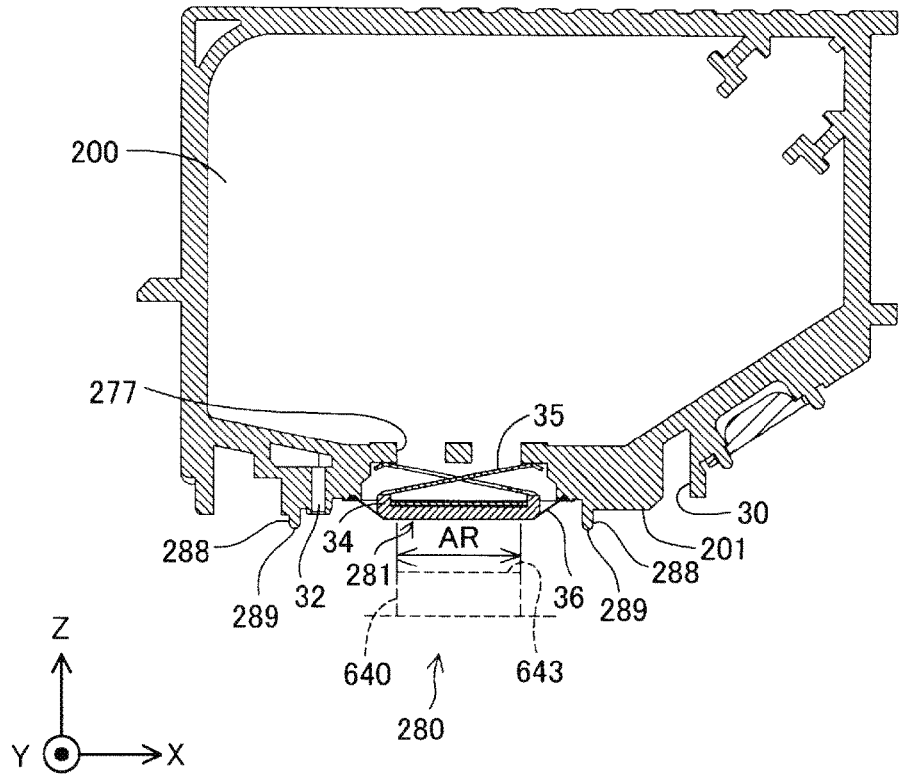
FIG. 14 is a cross-sectional view showing a structure of a liquid supply part.

FIG. 14 is a cross-sectional view showing the structure of the liquid supply part 280. In FIG. 14, the internal structure of the cartridge 20 except for the liquid supply part 280 is omitted. The liquid supply part 280 includes an opening 277, a filter 36 of the cartridge that covers the opening 277 on the outside face side of the first wall portion 201, and a liquid supply port 281. In this embodiment, the liquid supply part 280 further includes foam 34 and a leaf spring 35.

The liquid supply part 280 communicates with the liquid container 200 via the opening 277. The opening 277 is a hole that penetrates the first wall portion 201 in the Z axis direction. The filter 36 of the cartridge is arranged on the −Z axis direction side of the opening 277. The filter 36 of the cartridge is welded to the first wall portion 201 at the periphery of the opening 277. The filter 36 of the cartridge is formed by woven fabric, nonwoven fabric, or foamable resin (foam), for example. The leaf spring 35 made of metal is arranged on the opening 277 side between the opening 277 and the filter 36 of the cartridge, and the foam 34 is arranged on the filter 36 side of the cartridge.

When mounting the cartridge 20 to the holder 60, the leaf spring 35 indirectly presses the filter 36 of the cartridge against the filter 643 of the apparatus via the foam 34 so as to bring the filter 36 of the cartridge and the filter 643 of the apparatus into contact with each other. The leaf spring 35 is shaped so as to not prevent flow of ink from the opening 277 to the foam 34.

The foam 34 is a porous member that is arranged between the leaf spring 271 and a filter 273 of the container. The foam 34 supplies ink supplied from inside the liquid container 200 through the opening 277, to the filter 36 of the cartridge in a diffused manner. The foam 34 is formed by synthetic resin such as polyethylene terephthalate.

The liquid supply port 281 is an area through which ink in the liquid container 200 flows to the outside of the cartridge 20. Specifically, in the filter 36 of the cartridge, not the entire area of the filter, but an area AR that comes into contact with the filter 643 of the apparatus provided on the liquid introduction unit 640 of the holder 60 such that ink flows out is referred to as the liquid supply port 281, in this embodiment.

As shown in FIGS. 6 and 14, the outer peripheral wall 288 that surrounds the liquid supply part 280 is provided on the first wall portion 201. The outer peripheral wall 288 protrudes from the first wall portion 201 in the −Z axis direction. In the mounted state, an end portion 289 of the outer peripheral wall 288 in the −Z axis direction abuts on the sealing member 648 provided on the bottom wall portion 601 of the holder 60. The outer peripheral wall 288 and the sealing member 648 abut on each other in this manner, and thereby the space inward of the outer peripheral wall 288 becomes a substantially closed space. Hereinafter, this space is referred to as a "closed space".

In the first wall portion 201, a communication port 32 is formed between the outer peripheral wall 288 and the liquid supply part 280. The communication port 32 is an opening for allowing the closed space inward of the outer peripheral wall 288 to communicate with the exterior. In the mounted state, the communication port 32 allows the closed space inward of the outer peripheral wall 288 to communicate with the exterior (external air), and thereby the pressure difference between the closed space and the exterior is kept substantially constant. Therefore, leakage of ink from the liquid supply part 280 accompanying pressure fluctuation in the closed space is suppressed.

Figure 15:
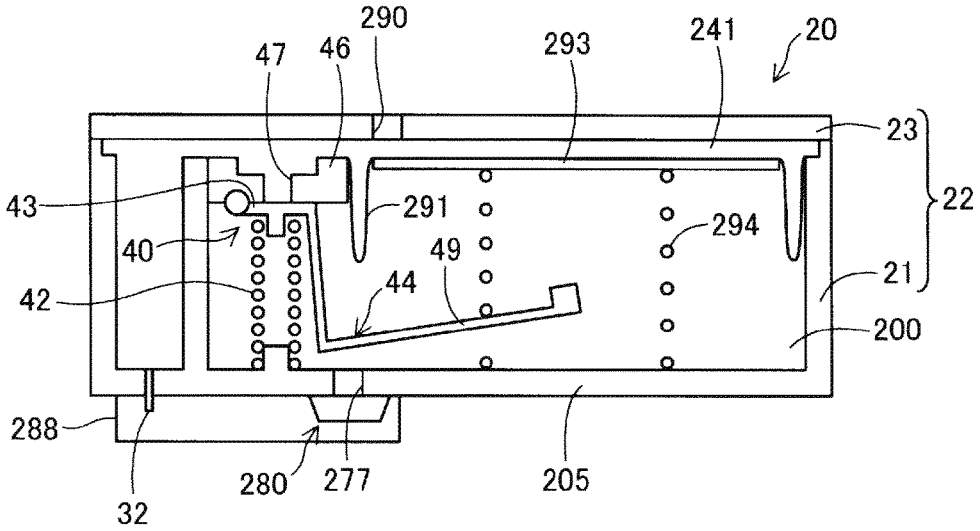
FIG. 15 is a schematic diagram illustrating an internal structure of the cartridge.
Figure 16:
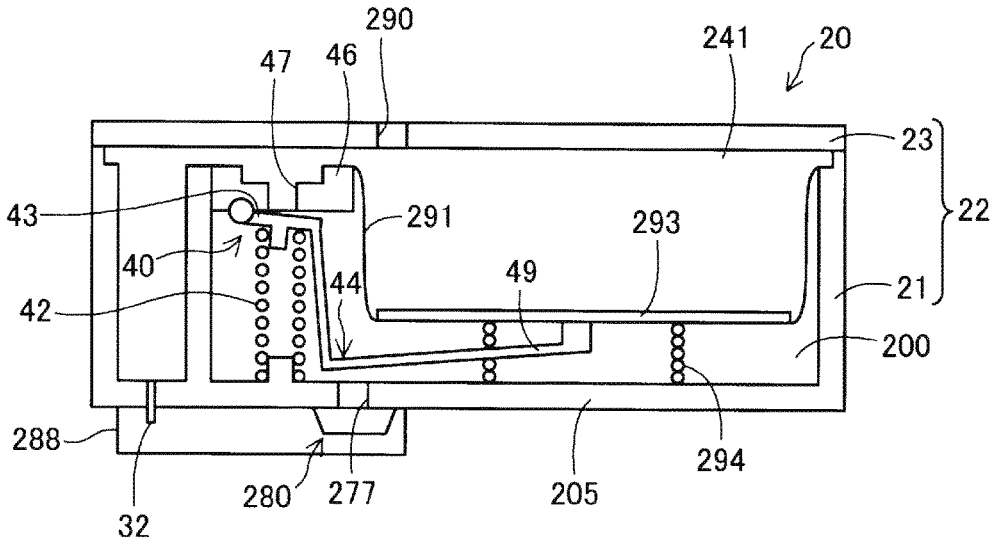
FIG. 16 is a schematic diagram illustrating an internal structure of the cartridge.
Figure 17:
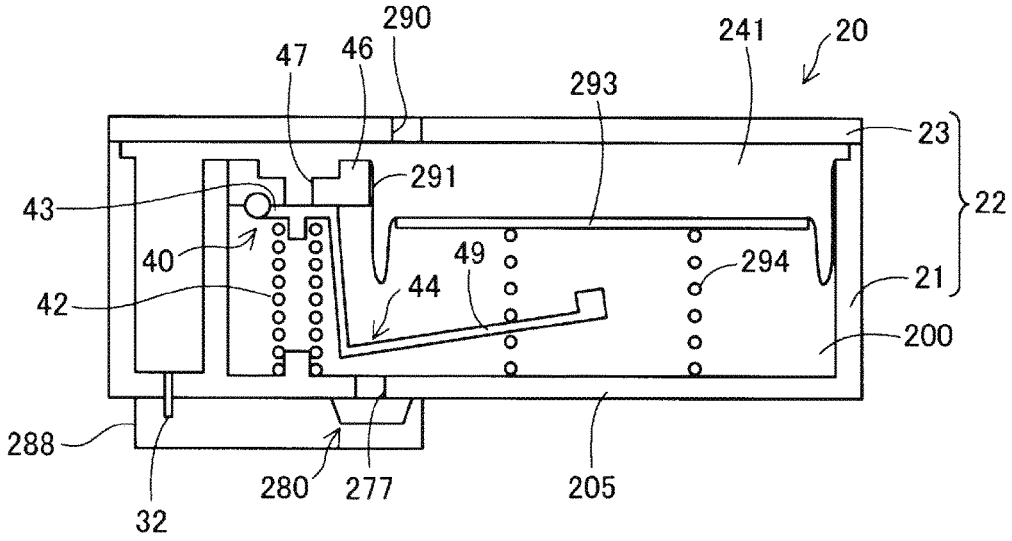
FIG. 17 is a schematic diagram illustrating an internal structure of the cartridge.

FIGS. 15 to 17 are schematic diagrams illustrating the internal structure of the cartridge 20. As shown in FIG. 15, the outer shell 22 of the cartridge 20 includes a main body member 21 and a lid member 23. The main body member 21 is constituted by the first wall portion 201, the second wall portion 202, the third wall portion 203, the fourth wall portion 204, the fifth wall portion 205 and the seventh wall portion 207. The lid member 23 constitutes the sixth wall portion 206. An internal space is formed in the cartridge 20 by attaching the lid member 23 so as to block the opening of the main body member 21. The communication port 32 is provided in the main body member 21. Also, the ventilation port 290 is provided in the lid member 23. Both the communication port 32 and the ventilation port 290 communicate with the atmospheric air. A sheet member 291 serving as a flexible member is positioned between the fifth wall portion 205 and the sixth wall portion 206 (the lid member 23).

The cartridge 20 is provided with the liquid container 200. The liquid container 200 is partitioned by the main body member 21 and the sheet member 291. Accordingly, ink is contained between the fifth wall portion 205 of the main body member 21 and the sheet member 291. The liquid container 200 communicates with the liquid supply part 280 via the opening 277. The cartridge 20 is also provided with an air chamber 241. The air chamber 241 is a space formed between the lid member 23 and the sheet member 291. The air chamber 241 communicates with the external atmospheric air through the ventilation port 290 provided in the lid member 23. Moreover, the communication port 32 communicates with the air chamber 241.

A pressure receiving plate 293 as a plate-like member is arranged in the liquid container 200. One face of the pressure receiving plate 293 is in contact with a face on the liquid container 200 side of the sheet member 291. Also, in the liquid container 200, a coil spring 294 serving as a biasing member is arranged between the other face (a face on the −Y axis direction side) of the pressure receiving plate 293 and the fifth wall portion 205. The coil spring 294 biases the pressure receiving plate 293 from the fifth wall portion 205 toward the sixth wall portion 206. Specifically, the coil spring 294 biases the sheet member 291 via the pressure receiving plate 293 in a direction in which the volume of the liquid container 200 is increased. The pressure in the liquid container 200 is maintained at a pressure lower than the atmospheric air pressure (negative pressure) due to this biasing force of the coil spring 294.

In this embodiment, in planar view in a direction from the fifth wall portion 205 toward the sixth wall portion 206, the coil spring 294 is a spring having a cylindrical shape such that the diameter of a portion of the coil spring 294 that is close to the fifth wall portion 205 and the diameter of a portion that is close to the sixth wall portion 206 are uniform. However, the shape of the coil spring 294 is not limited to such a shape, and the diameter of the portion close to the fifth wall portion 205 and the diameter of the portion close to the sixth wall portion 206 may be different.

The atmospheric air is introduced into the liquid container 200 via the ventilation port 290, the air chamber 241 and an air introduction port 47 at a predetermined timing. The air introduction port 47 is a communication hole that allows the space (the liquid container 200) between the fifth wall portion 205 and the sheet member 291 to communicate with the space (the air chamber 241) between the sixth wall portion 206 and the sheet member 291. The cartridge 20 is provided with an atmospheric air valve 40 for opening/closing this air introduction port 47. The atmospheric air valve 40 is provided with a valve seat 46, a valve member 44, and a coil spring 42. The valve member 44 is provided with a valve portion 43 and a lever portion 49. The valve portion 43 abuts on the valve seat 46 and is separated from the valve seat 46, thereby opening and closing the air introduction port 47. The valve portion 43 of the valve member 44 is pressed against the valve seat 46 by the coil spring 42, and blocks the air introduction port 47, which is a through hole formed in the valve seat 46. The valve portion 43 opens/closes the air introduction port 47. The lever portion 49 abuts on the pressure receiving plate 293, thereby moving the valve portion 43. The lever portion 49 moves the valve portion 43, thereby separating the valve portion 43 from the valve seat 46, and opening the air introduction port 47.

The operations of the cartridge 20 will be described below. In an initial state (non-usage state) of the cartridge 20, the liquid container 200 is filled with ink. At this time, the pressure receiving plate 293 is at a position closest to the lid member 23, as shown in FIG. 15.

As shown in FIG. 16, when ink in the liquid container 200 is consumed and the pressure receiving plate 293 approaches the fifth wall portion 205, the pressure receiving plate 293 presses the lever portion 49 toward the fifth wall portion 205. This separates the valve portion 43 from the air introduction port 47. Accordingly, the valve member 44 enters an opened-valve state. The external air then flows into the liquid container 200 through the ventilation port 290, the air chamber 241 and the air introduction port 47. This increases the volume of the liquid container 200 by the amount of the introduced air as shown in FIG. 17. At the same time, the negative pressure in the liquid container 200 decreases and approaches the atmospheric air pressure. When a certain amount of air is introduced into the liquid container 200, the pressure receiving plate 293 is separated from the lever portion 49. Accordingly, the valve portion 43 blocks the air introduction port 47 again. In other words, the valve member 44 enters a closed-valve state. In this manner, when the negative pressure in the liquid container 200 increases in accordance with the consumption of ink in the liquid container 200, the valve member 44 temporally enters an opened-valve state, and thereby it becomes possible to maintain the pressure in the liquid container 200 in a range of an appropriate pressure. Therefore, for example, it becomes possible to suppress excessive increase in negative pressure in the liquid container 200 and prevention of supply of ink from the liquid supply part 280.

Figure 18:
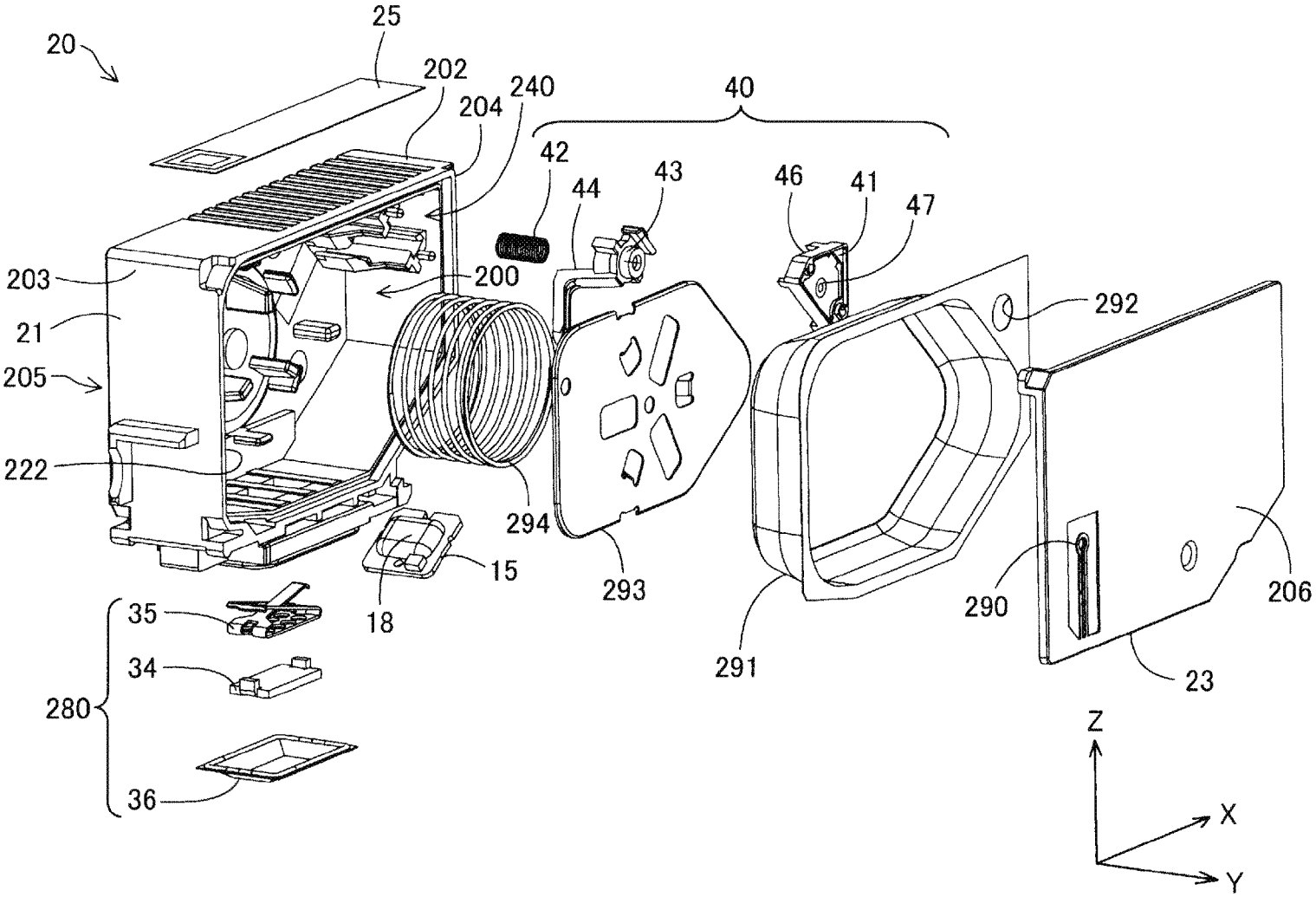
FIG. 18 is an exploded perspective view of the cartridge.

FIG. 18 is an exploded perspective view of the cartridge 20. The cartridge 20 is provided with the main body member 21, the lid member 23 having a plate-like shape, and the sheet member 291 having flexibility. The main body member 21 is substantially rectangular parallelepiped-shaped. The main body member 21 has an opening 222 on the +Y axis direction side and is recess-shaped. The sheet member 291 is adhered or welded to the main body member 21, and the sheet member 291 and the main body member 21 define and form the liquid container 200. Accordingly, a portion of the outer peripheral wall of the liquid container 200 is formed by the sheet member 291. A through hole 292 that allows the air chamber 241 and the air introduction port 47 to communicate with each other is formed in the sheet member 291.

The lid member 23 is attached to the main body member 21 so as to cover the sheet member 291. The main body member 21 and the lid member 23 are formed by synthetic resin such as polypropylene. The sheet member 291 is formed by synthetic resin such as a material containing nylon and polypropylene.

The pressure receiving plate 293 is formed by synthetic resin such as polypropylene or metal such as stainless steel. The pressure receiving plate 293 is arranged so as to be in contact with the sheet member 291. The coil spring 294 is arranged in the liquid container 200. The coil spring 294 abuts on the pressure receiving plate 293 and a face opposing the pressure receiving plate 293 among the faces of the main body member 21. The pressure receiving plate 293 moves in the liquid container 200 in accordance with the consumption of ink in the liquid container 200. The direction of movement of the pressure receiving plate 293 is (a direction along) the Y axis direction.

The atmospheric air valve 40 is provided with the coil spring 42, the valve member 44 and the valve seat 46. The valve seat 46 is housed in a corner portion 240 of the main body member 21 in which the second wall portion 202 and the fourth wall portion 204 cross each other, and is attached to the main body member 21. The valve seat 46 is formed by synthetic resin such as polypropylene. The valve seat 46 has a recess portion, and the sheet member 291 is airtightly adhered to an end face 41 that forms the opening of the recess portion. The recess portion of the valve seat 46 communicates with the through hole 292 of the sheet member 291. Moreover, the air introduction port 47 that penetrates to the back side of the valve seat 46 is formed in the bottom portion of the recess portion of the valve seat 46.

The valve member 44 is formed by synthetic resin such as polypropylene. The valve member 44 may be formed by two-color molding using an elastic member such as elastomer and synthetic resin such as polypropylene.

A sticker 25 may be adhered to the outer surface of the second wall portion 202 of the main body member 21. The manufacturer and the model number of the cartridge 20 are indicated on the sticker 25, for example. Note that the sticker 25 may be adhered at any position. For example, the sticker 25 may be adhered to any one of the second wall portion 202, the third wall portion 203, the fourth wall portion 204, the fifth wall portion 205 and the sixth wall portion 206, or may be adhered across two or more wall portions. Also, a plurality of stickers may be adhered on a plurality of wall portions.

Figure 19:
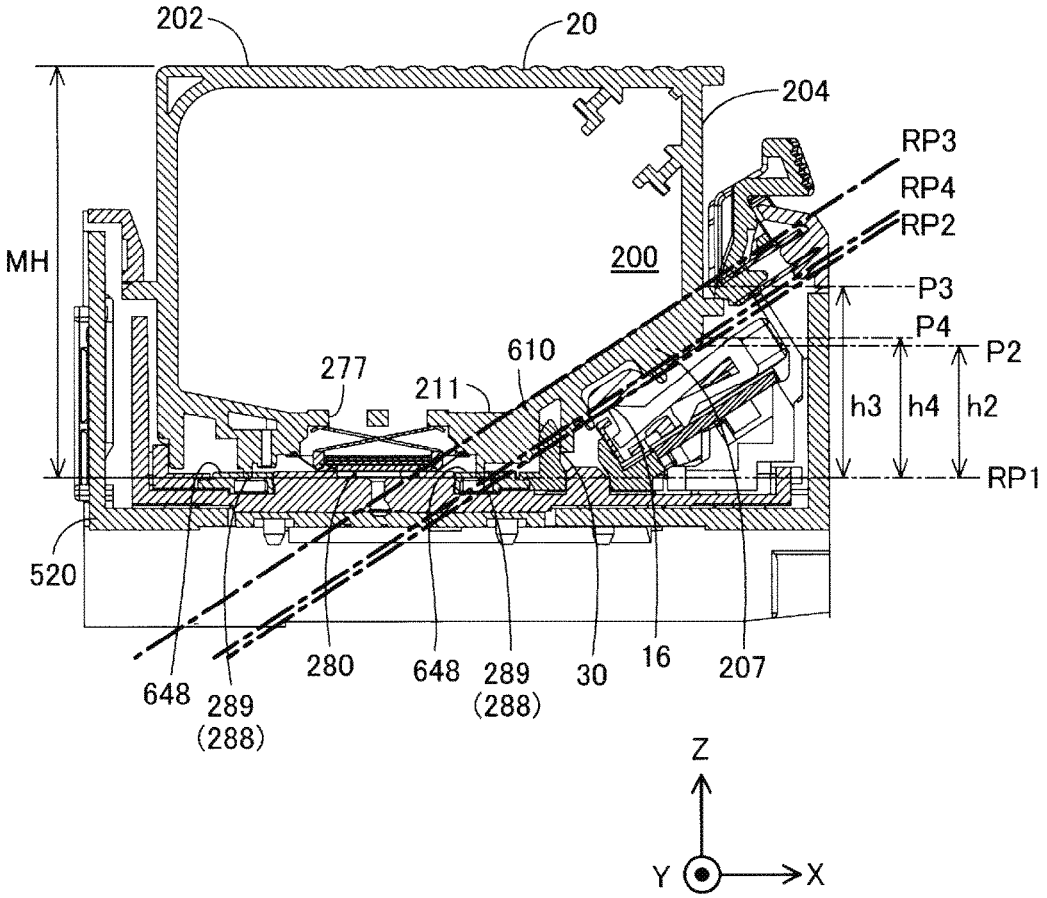
FIG. 19 is an XZ cross-sectional view of the cartridge and a carriage unit.

FIG. 19 is an XZ cross-sectional view of the cartridge 20 and the carriage unit 520 in the mounted state. In FIG. 19, four reference planes RP1 to RP4 that are parallel in the Y axis direction are shown. In the mounted state, the first reference plane RP1 is a plane including a face on which the end portion 289 of the outer peripheral wall 288 and the sealing member 648 abut on each other. The second reference plane RP2 is a plane including the plurality of contact portions 16. To be more specific, the second reference plane RP2 is a plane including the two rows R1 and R2 (FIG. 6) formed by the plurality of contact portions 16. The third reference plane RP3 is a plane including a face on the liquid container 200 side of the seventh wall portion 207. The fourth reference plane RP4 is a plane including a face on the substrate 15 side of the seventh wall portion 207.

In the following description, a direction orthogonal to the first reference plane RP1 is referred to as a Z axis direction. Also, a direction orthogonal to the Z axis direction is referred to as an X axis direction or a Y axis direction. The X axis direction, the Y axis direction, and the Z axis direction are orthogonal to each other. Also, the X axis direction is set to be a direction in which the carriage unit 520 moves in a state in which the cartridge 20 is mounted in the carriage unit 520. Moreover, in the following description, the position of the positioning portion 30 is a position in a face on the −Z axis direction side of the first wall portion 201, and unless particularly stated otherwise, the depth of a recess formed in the Z axis direction is not taken into consideration.

In this embodiment, in planar view of the cartridge 20 in the Z axis direction, the positioning portion 30 is positioned between the end portion 289 of the outer peripheral wall 288 and the plurality of contact portions 16 in the X axis direction. Also, in planar view of the cartridge 20 in the X axis direction, the positioning portion 30 is positioned between the end portion 289 of the outer peripheral wall 288 and the plurality of contact portions 16 in the Z axis direction. Furthermore, the second reference plane RP2 crosses the sealing member 648. According to such a configuration, the position of the positioning portion 30 can be brought close to both the liquid supply part 280 and the substrate 15. Therefore, it is possible to increase both the accuracy of the contact position of the substrate 15 and the electrode part 61 and the accuracy of the contact position of the liquid supply part 280 and the liquid introduction unit 640. In other words, it is possible to improve the accuracy of both the contact position of the liquid supply port 281 of the cartridge 20 with the printer 50 and the contact position of the contact portions 16 with the printer 50.

Moreover, in this embodiment, in planar view in the Z axis direction, the positioning portion 30 is closer to one of the plurality of contact portions 16 than to the end portion 289 of the outer peripheral wall 288 in the X axis direction. In other words, in planar view in the Z axis direction, the shortest distance between the contact portion 16 that is closest to the positioning portion 30 among the plurality of contact portions 16 and the positioning portion 30 is shorter than the shortest distance between the end portion 289 of the outer peripheral wall 288 and the positioning portion 30 in the X axis direction. Furthermore, in planar view of the cartridge 20 in the X axis direction, the positioning portion 30 is closer to the end portion 289 of the outer peripheral wall 288 than to the plurality of contact portions 16 in the Z axis direction. In other words, in planar view in the X axis direction, the shortest distance between the end portion 289 of the outer peripheral wall 288 and the positioning portion 30 is shorter than the shortest distance between the plurality of contact portions 16 and the positioning portion 30 in the Z axis direction. Therefore, it is possible to improve the accuracy of both the contact position of the liquid supply port 281 of the cartridge 20 with the printer 50 and the contact position of the contact portions 16 of the cartridge 20 with the printer 50.

Moreover, in this embodiment, in planar view of the cartridge 20 in the X axis direction, the positioning portion 30 is positioned between a face 211 of the first wall portion 201 that opposes the second wall portion 202 and the end portion 289 of the outer peripheral wall 288 in the Z axis direction. Therefore, the positioning portion 30 can be brought close to the liquid supply port 281. Therefore, it is possible to improve the accuracy of the contact position of the liquid supply port 281 of the cartridge 20 with the printer 50.

Moreover, in this embodiment, in planar view of the cartridge 20 in the Z axis direction, the positioning portion 30 is positioned between the seventh wall portion 207 and the end portion 289 of the outer peripheral wall 288 in the X axis direction. Therefore, the positioning portion 30 can be brought close to the liquid supply part 280. Therefore, it is possible to improve the accuracy of the contact position of the liquid supply port 281 of the cartridge 20 with the printer 50.

Moreover, in this embodiment, in planar view of the cartridge 20 in the X axis direction, the positioning portion 30 is positioned between the opening 277 and the end portion 289 of the outer peripheral wall 288 in the Z axis direction. Therefore, the positioning portion 30 can be brought close to the liquid supply part 280. Therefore, it is possible to improve the accuracy of the contact position of the liquid supply port 281 of the cartridge 20 with the printer 50.

Moreover, in this embodiment, the outer peripheral wall 288 and the positioning portion 30 are provided on the first wall portion 201, and the third reference plane RP3 crosses the liquid supply part 280. Therefore, the position of the positioning portion 30 can be brought close to both the liquid supply part 280 and the substrate 15. Therefore, it is possible to improve the accuracy of both the contact position of the liquid supply port 281 of the cartridge 20 with the printer 50 and the contact position of the contact portions 16 of the cartridge 20 with the printer 50.

Moreover, in this embodiment, the outer peripheral wall 288 and the positioning portion 30 are provided on the first wall portion 201, and the fourth reference plane RP4 crosses the sealing member 648. Therefore, the position of the positioning portion 30 can be brought close to both the liquid supply part 280 and the substrate 15. Therefore, it is possible to improve the accuracy of both the contact position of the liquid supply port 281 of the cartridge 20 with the printer 50 and the contact position of the contact portions 16 of the cartridge 20 with the printer 50.

Moreover, in this embodiment, in the mounted state, all of the heights h2 to h4, from the first reference plane RP1 in the Z axis direction, of positions P2 to P4 at which the respective reference planes RP2 to RP4 intersect the outer surface of the fourth wall portion 204 are less than or equal to half the height from the first reference plane RP1 to the outer surface of the second wall portion 202, namely, the maximum height MH of the cartridge 20. To be more specific, the height h2, from the first reference plane RP1, of the position P2 at which the second reference plane RP2 intersects the outer surface of the fourth wall portion 204 is less than or equal to half the maximum height MH of the cartridge. Also, the height h3 from the first reference plane RP1 of the position P3 at which the third reference plane RP3 intersects the outer surface of the fourth wall portion 204 is less than or equal to half the maximum height MH of the cartridge. Moreover, the height h4 from the first reference plane RP1 of the position P4 at which the fourth reference plane RP4 intersects the outer surface of the fourth wall portion 204 is less than or equal to half the maximum height MH of the cartridge. According to such a configuration, the positioning portion 30 and the substrate 15 can be provided so as to be close to each other, and thus it is possible to increase the accuracy of the contact position of the substrate 15 and the electrode part 61. Note that the rising angle (inclination angle) of each of the reference planes RP2 to RP4 from the first reference plane RP1 is preferably 15 to 45°, and is more preferably 30 to 40°.

In this embodiment, by adopting the above-described configuration, the positions of the positioning portion 30 and the liquid supply part 280 can be brought close, and the positions of the positioning portion 30 and the contact portions 16 can be brought close. Accordingly, the positions of the liquid supply part 280 and the contact portions 16 can be brought close to each other. Therefore, the length of the cartridge 20 in the X axis direction can be reduced. Note that if the length of the cartridge 20 in the X axis direction is simply reduced, the volume of the liquid container 200 is reduced. In view of this, in order to ensure a volume, it is preferred to increase the length (height) of the cartridge 20 in the Z axis direction, or to increase the length (width) in the Y axis direction. In this embodiment, the cartridge 20 is arranged in a direction perpendicular to a direction (the X axis direction) in which the carriage unit 520 moves (see FIG. 1), and thus even if the length of the cartridge 20 in the Y axis direction is increased, it is possible to suppress an increase in the size of the casing of the printer 50 in the direction of the movement of the carriage unit 520. Moreover, in this embodiment, the length of the cartridge 20 in the Y axis direction can be increased, and thus it is possible to suppress an increase in the size of the cartridge 20 in the Z axis direction. Therefore, it is also possible to suppress an increase in the size of the casing of the printer 50 in the height direction. Therefore, according to this embodiment, the size of the printer 50 can be reduced.

Figure 20:
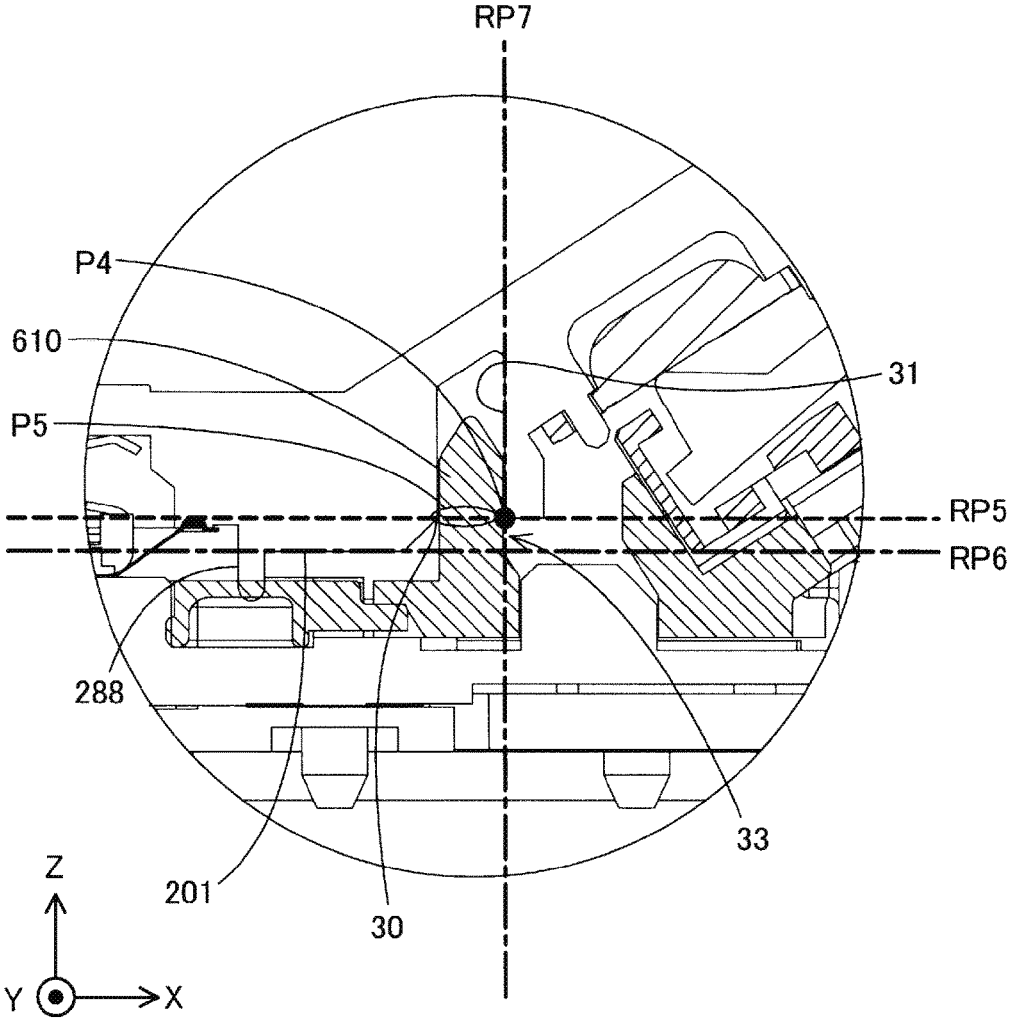
FIG. 20 is an explanatory view showing an effect of a positioning portion.

FIG. 20 is an explanatory view showing an effect of the positioning portion 30. A fifth reference plane RP5 shown in FIG. 20 is a plane parallel to the XY plane, and is a plane that passes through the end portion in the −Z axis direction of an internal face 31 that faces the −X axis direction side of the positioning portion 30. A sixth reference plane RP6 is a plane parallel to the XY plane, and is a plane that passes through the outer surface between the positioning portion 30 and the outer peripheral wall 288. A seventh reference plane RP7 is a plane that is parallel to the YZ plane, and is a plane that passes through the internal face 31 on the +X axis direction side of the positioning portion 30 in the mounted state. In this embodiment, the fifth reference plane RP5 and the sixth reference plane RP6 are different planes, because the positioning portion 30 has, at the end portion thereof in the −Z axis direction, an opening portion 33 that is directed in the +X axis direction. The opening portion 33 is used for guiding the projection 610 into the positioning portion 30 when the cartridge 20 is mounted to the holder 60.

When the cartridge 20 is mounted to the printer 50, the positioning portion 30 fits with the projection 610 provided on the holder 60. The positioning portion 30 then abuts on at least a portion of the projection 610.

In this embodiment, the projection 610 provided on the holder 60 may abut on the positioning portion 30 in all or any one of the directions indicated by 1 to 3 as follows.

1. a direction from the third wall portion 203 toward the fourth wall portion 204 (the +X axis direction).
2. a direction from the fifth wall portion 205 toward the sixth wall portion 206 (the +Y axis direction).
3. a direction from the sixth wall portion 206 toward the fifth wall portion 205 (the −Y axis direction).

In the case where a direction in which the projection 610 abuts on the positioning portion 30 is the direction 1, the positioning portion 30 is an intersection P4 portion between the fifth reference plane RP5 and the seventh reference plane RP7 in FIG. 20, in a narrow sense. In FIG. 20, the intersection P4 indicates a position that is in the abutting portion and is closest to the holder 60. In other words, in the case where a direction in which the projection 610 abuts on the positioning portion 30 is the direction 1, the positioning portion 30 is positioned in the internal face 31 that forms the recess provided in the first wall portion 201, and is directed on the −X axis direction side.

If the projection 610 abuts on the positioning portion 30 in the direction 1, it is possible to increase the position accuracy of the cartridge 20 in the depth direction (the +X axis direction). Also, the cartridge 20 is biased by the electrode part 61 of the holder 60 in the −X axis direction, and thus if the projection 610 abuts on the positioning portion 30 in the direction 1, it is possible to restrict the movement of the cartridge 20 in the −X axis direction.

In the case where a direction in which the projection 610 abuts on the positioning portion 30 is the direction 2 or 3, the positioning portion 30 is, in FIG. 20, a portion P5 in which the fifth reference plane RP5 and the projection 610 intersect, in a narrow sense. In FIG. 20, the intersection portion P5 indicates a position that is in the abutting portion, and is closest to the holder 60. In the case where a direction in which the projection 610 abuts on the positioning portion 30 is the direction 2, the positioning portion 30 is positioned in an internal face that forms the recess provided in the first wall portion 201, and is directed on the −Y axis direction side. In the case where a direction in which the projection 610 abuts on the positioning portion 30 is the direction 3, the positioning portion 30 is positioned in an internal face that forms the recess provided in the first wall portion 201, and is directed on the +Y axis direction side.

If the projection 610 abuts on the positioning portion 30 in the direction 2 or 3, it is possible to increase the position accuracy of the cartridge 20 in the width direction (the Y axis direction).

B. Variations

Variation 1

In the above embodiment, as long as each of the first wall portion 201 to the seventh wall portion 207 can constitute the cartridge 20, the shapes of portions directed outward and the shapes of portions directed inward do not need to be flat, and a structure that includes recessions and protrusions may be adopted. For example, the first restriction portion 210 of the cartridge may be provided on or included in the fourth wall portion 204, as a portion of recessions and protrusions of the fourth wall portion 204. The second restriction portion 221 of the cartridge may be provided on or included in the third wall portion 203, as a portion of recessions and protrusions of the third wall portion 203. Also, the outer peripheral wall 288 that surrounds the liquid supply part 280 may be provided on or included in the first wall portion 201, as a portion of recessions and protrusions of the first wall portion 201.

Variation 2

In the above embodiment, as shown in FIG. 12, the distance LX between the third wall portion 203 and the fourth wall portion 204 that constitute the cartridge 20 is greater than the distance LY between the fifth wall portion 205 and the sixth wall portion 206. However, the distance LX between the third wall portion 203 and the fourth wall portion 204 may be smaller than the distance LY between the fifth wall portion 205 and the sixth wall portion 206. Moreover, in the above embodiment, when put in ascending order, the length (length in the X axis direction), the height (length in the Z axis direction) and the width (length in the Y axis direction) of the cartridge 20 are in the following order: length, height, width. However, the size relation of the length, the width and the height of the cartridge 20 can be arbitrarily changed, and for example, when put in ascending order, the order may be: height, length, width, or the height, the length and the width may be equal.

Variation 3

In the above embodiment, as shown in FIG. 14, the liquid supply part 280 is provided with the foam 34 and the leaf spring 35. However, as long as ink can be supplied from the liquid container 200 to the liquid introduction unit 640 of the printer 50, the liquid supply part 280 may have any structure. For example, either the foam 34 or the leaf spring 35 may be omitted. Moreover, all of or some of the filter 36 of the cartridge, the foam 34 and the leaf spring 35 may be replaced by foam.

Variation 4

In the above embodiment, the cartridge 20 satisfies a first condition that the second reference plane RP2 crosses the sealing member 648, a second condition that the third reference plane RP3 crosses the liquid supply part 280, and a third condition that the fourth reference plane RP4 crosses the sealing member 648. However, the cartridge 20 does not need to satisfy all of these conditions. For example, it suffices for the cartridge 20 to satisfy only one condition, or to satisfy two conditions.

Variation 5

In the above embodiment, a plurality of cartridges 20 are arranged in a direction perpendicular to the direction of the movement of the carriage unit 520 and are mounted to the holder 60. However, a plurality of cartridges 20 may be arranged in the direction of the movement of the carriage unit 520 and be mounted to the holder 60.

Variation 6

In the above embodiment, in planar view of the cartridge 20 in the Z axis direction, the positioning portion 30 is closer to any one of the plurality of contact portions 16 than the end portion 289 of the outer peripheral wall 288 in the X axis direction. However, the positioning portion 30 may be closer to the end portion 289 of the outer peripheral wall 288 than the plurality of contact portions 16.

Variation 7

In the above embodiment, in planar view of the cartridge 20 in the X axis direction, the positioning portion 30 is closer to the end portion 289 of the outer peripheral wall 288 than the plurality of contact portions 16 in the Z axis direction. However, the positioning portion 30 may be closer to the plurality of contact portions 16 than the end portion 289 of the outer peripheral wall 288.

Variation 8

In the above embodiment, the cartridge 20 is constituted by seven wall portions. However, as long as a space that can contain ink is formed, the number of wall portions that constitute the cartridge 20 is not limited to seven. For example, the cartridge 20 may be constituted by six or fewer wall portions, or may be constituted by eight or more wall portions. Moreover, for example, the cartridge 20 may be constituted by one or more wall portions that are spherical or curved. Alternatively, the cartridge 20 may be constituted by a combination of curved wall portions and plate-like wall portions.

Variation 9

In the above embodiment, in planar view of the cartridge 20 in the X axis direction, the positioning portion 30 is positioned between the face 211 of the first wall portion 201 that opposes the second wall portion 202 and the end portion 289 of the outer peripheral wall 288 in the Z axis direction. However, the positioning portion 30 may be positioned on the +Z axis direction side relative to the face 211 of the first wall portion 201 that opposes the second wall portion 202. The positioning portion 30 may also be positioned on the −Z axis direction side relative to the end portion 289 of the outer peripheral wall 288.

Variation 10

In the above embodiment, in planar view of the cartridge 20 in the Z axis direction, the positioning portion 30 is positioned between the seventh wall portion 207 and the end portion 289 of the outer peripheral wall 288 in the X axis direction. However, the positioning portion 30 may be positioned on the seventh wall portion 207, for example.

Variation 11

In the above embodiment, in planar view of the cartridge 20 in the X axis direction, the positioning portion 30 is positioned between the opening 277 and the end portion 289 of the outer peripheral wall 288 in the Z axis direction. However, the positioning portion 30 may be positioned on the +Z axis direction side relative to the opening 277. The positioning portion 30 may also be positioned on the −Z axis direction side relative to the end portion 289 of the outer peripheral wall 288.

Variation 12

The present invention is not limited to an inkjet printer and an ink cartridge thereof, and can also be applied to any liquid ejection apparatus that consumes liquid other than ink and a cartridge (liquid supply unit) used for such a liquid ejection apparatus. For example, the present invention can be applied as a cartridge used for various liquid ejection apparatuses as follows:

(1) an image recording apparatus such as a facsimile apparatus,
(2) a color material ejection apparatus used for manufacturing color filters for an image display device such as a liquid crystal display,
(3) an electrode material ejection apparatus used for forming electrodes for an organic EL (Electro Luminescence) display, an FED (Field Emission Display) and the like,
(4) a liquid ejection apparatus for ejecting a liquid containing biological organic matter used for manufacturing biochips,
(5) a sample ejection apparatus serving as a precision pipette,
(6) a lubricant ejection apparatus,
(7) a resin liquid ejection apparatus,
(8) a liquid ejection apparatus for ejecting a lubricant at pinpoint for a precision device such as a timepiece and a camera,
(9) a liquid ejection apparatus for ejecting a transparent resin liquid such as an ultraviolet-curing resin liquid onto a substrate in order to form, for example, a hemispherical micro lens (optical lens) used in an optical communication element or the like,
(10) a liquid ejection apparatus for ejecting an acid or alkali etching solution in order to etch a substrate or the like, and

(11) a liquid ejection apparatus provided with a liquid consumption head for discharging a minute amount of any other liquid droplets.

Note that "liquid droplets" refer to a state of a liquid that is discharged from a liquid ejection apparatus, and includes a liquid that leaves a trail in the form of particles, tears, or threads. It suffices for the "liquid" as referred to herein to be such a material that can be consumed by a liquid ejection apparatus. For example, it suffices for the "liquid" to be a material in a state in which the substance is in the liquid phase, and the "liquid" includes materials in a liquid state such as high- or low-viscosity liquids, and materials in a liquid state such as sols, gel waters, other inorganic solvents, organic solvents, solutions, liquid resins, and liquid metals (molten metals). The "liquid" includes not only liquids in the form of one state of a substance, but also solvents into which particles of a functional material composed of a solid matter such as a pigment or metal particles has been dissolved, dispersed or mixed, and the like. Representative examples of liquids include not only ink, such as was described in the above embodiment, but also liquid crystal and the like. Herein, the term "ink" encompasses a variety of compositions in the form of a liquid, such as general water-soluble inks and oil-soluble inks as well as gel inks, hot melt inks, and the like.

The invention is not limited to the above embodiment and variations, and can be achieved as various configurations without departing from the gist of the invention. For example, the technical features in the embodiment and variations that correspond to the technical features in the aspects described in the summary of the invention may be replaced or combined as appropriate in order to solve a part of, or the entire foregoing problem, or to achieve some or all of the above-described effects. The technical features that are not described as essential in the specification may be deleted as appropriate.

The entire disclosure of Japanese Patent Application No. 2015-231549, filed Nov. 27, 2015, is expressly incorporated by reference herein.

What is claimed is:

1. A liquid supply unit configured to be mounted to a liquid ejection apparatus provided with a projection and an electrode part, the liquid supply unit comprising:

a bottom wall;

a liquid supply part provided on the bottom wall;

an outer peripheral wall that surrounds the liquid supply part;

a plurality of contact portions that come into contact with the electrode part; and a concave portion that is configured to receive the projection, wherein, when a plane including an end portion of the outer peripheral wall is referred to as a first reference plane, a direction orthogonal to the first reference plane is referred to as a Z axis direction, a direction orthogonal to the Z axis direction is referred to as an X axis direction, a direction orthogonal to the Z axis direction and the X axis direction is referred to as a Y axis direction, and a plane including the plurality of contact portions, when the liquid supply unit is mounted to the liquid ejection apparatus, is referred to as a second reference plane, then, in planar view of the liquid supply unit in the Z axis direction, the concave portion is positioned adjacent to the outer peripheral wall and the plurality of contact portions in the X axis direction, while in planar view of the liquid supply unit in the X axis direction, the concave portion is positioned adjacent to the outer peripheral wall and the plurality of contact portions in the Z axis direction.

2. The liquid supply unit according to claim 1, wherein in planar view of the liquid supply unit in the Z axis direction, the concave portion is closer to any one of the plurality of contact portions than to the outer peripheral wall in the X axis direction.

3. The liquid supply unit according to claim 1, wherein in planar view of the liquid supply unit in the X axis direction, the concave portion is closer to the outer peripheral wall than to the plurality of contact portions in the Z axis direction.

4. The liquid supply unit according to claim 1, wherein in planar view of the liquid supply unit in the X axis direction, the concave portion is provided on an end of the bottom wall.

5. The liquid supply unit according to claim 1, wherein the liquid supply part comprises an opening formed in the bottom wall and a filter that covers the opening.

6. The liquid supply unit according to claim 1, further comprising:

an upper wall opposing the bottom wall in the Z axis direction;

two end walls opposing each other in the X direction, and intersecting the bottom wall and the upper wall; and two side walls opposing each other in the Y direction, and intersecting the bottom wall, the upper wall, and the two end walls; wherein a distance between the two end walls is greater than a distance between the two side walls.

7. The liquid supply unit according to claim 1, further comprising:

an upper wall opposing the bottom wall in the Z axis direction;

two end walls opposing each other in the X direction, and intersecting the bottom wall and the upper wall;

two side walls opposing each other in the Y direction, and intersecting the bottom wall, the upper wall, and the two end walls; and an inclined wall intersecting the bottom wall, the two side walls, and at least one of the end walls, the inclined wall having an outer face on which the plurality of contact portions are provided, and having an inner face opposite to the outer face;

wherein a plane including a face on a liquid container side of the seventh wall portion crosses the liquid supply part.

8. The liquid supply unit according to claim 7, further comprising a substrate placed on the inclined wall, wherein the plurality of contact portions are provided on the substrate.

9. The liquid supply unit according to claim 1, further comprising a substrate on which the plurality of contact portions are provided.

10. The liquid supply unit according to claim 1, further comprising:

an upper wall opposing the bottom wall in the Z axis direction;

two end walls opposing each other in the X direction, and intersecting the bottom wall and the upper wall; and two side walls opposing each other in the Y direction, and intersecting the bottom wall, the upper wall, and the two end walls, wherein a distance between the two end walls is greater than a distance between the two side walls.

11. The liquid supply unit according to claim 1, wherein the bottom wall does not include an optical element disposed between the liquid supply part and the concave portion.

12. The liquid supply unit according to claim 1, further comprising:

an upper wall opposing the bottom wall in the Z axis direction;

two end walls opposing each other in the X direction, and intersecting the bottom wall and the upper wall; and two side walls opposing each other in the Y direction, and intersecting the bottom wall, the upper wall, and the two end walls, wherein at least one of the two side walls has a side that is parallel to the second reference plane, and in planar view of the liquid supply unit in the Y axis direction, an imaginary extension of the side that is parallel to the second reference plane crosses the outer peripheral wall.

13. A liquid ejection apparatus comprising:

the liquid supply unit according to claim 1; and a carriage unit to which the liquid supply unit is mounted, the carriage unit including:

a sealing member that abuts the outer peripheral wall;

a projection that is configured to be received into the concave portion; and an electrode part that is configured to come into contact with the plurality of contact portions;

wherein the carriage unit moves in the X axis direction.

14. A liquid ejection apparatus comprising:

the liquid supply unit according to claim 1; and a carriage unit to which the liquid supply unit is mounted, the carriage unit including:

a sealing member that abuts the outer peripheral wall;

a projection that is received by the concave portion; and an electrode part that comes into contact with the plurality of contact portions, wherein the second reference plane crosses the sealing member.

* * * * *